US005967898A

United States Patent [19]

Takasaka et al.

[11] Patent Number: 5,967,898

[45] Date of Patent: Oct. 19, 1999

[54] TABLET UNIT

[75] Inventors: Akira Takasaka; Iwakichi Ogawa, both of Tokyo, Japan

[73] Assignee: Sega Enterprises, Ltd., Tokyo, Japan

[21] Appl. No.: 08/825,059

[22] Filed: Mar. 27, 1997

[30] Foreign Application Priority Data

Mar. 29, 1996 [JP] Japan ..... 8-075671

[51] Int. Cl.[6] ..... A63F 9/00

[52] U.S. Cl. ..... 463/37; 273/237; 446/7

[58] Field of Search ..... 463/36, 37, 38, 463/39, 46, 47; 273/148 B, 237, 238, 240; 434/338, 339, 362, 317; 446/7, 8

[56] References Cited

U.S. PATENT DOCUMENTS

| | | | |
|---|---|---|---|
| Re. 33,662 | 8/1991 | Blair et al. | 364/410 |
| 4,353,552 | 10/1982 | Pepper, Jr. | 463/37 |
| 4,716,804 | 1/1988 | Chadabe | 84/1.03 |
| 4,899,137 | 2/1990 | Behrens et al. | 340/711 |
| 4,945,357 | 7/1990 | Tal | 341/20 |
| 5,269,522 | 12/1993 | Chagoll et al. | 273/138 A |
| 5,681,220 | 10/1997 | Bertram et al. | 463/37 |

FOREIGN PATENT DOCUMENTS 5137846 6/1993 Japan .

*Primary Examiner*—Jessica J. Harrison
*Attorney, Agent, or Firm*—Dickstein Shapiro Morin & Oshinsky

[57] ABSTRACT

A tablet unit 10 for a vehicle includes a dashboarded-shaped body 36, a handle 42, and a touch pen hold unit 50. The dashboard-shaped body 36 includes a receiving antenna 138 which is interlocked with an operation of the handle and is moved on a tablet opposed surface 52. The receiving antenna 138 inputs electromagnetic waves from a tablet 28 and transmits positional information corresponding to the electromagnetic waves to an antenna on the touch pen 32 holding the touch pen 32 through cables 160*a*, 160*b*. A drive game is played by operating the handle, which makes the drive game realistic in comparison with that played by operating the touch pen 32. Tablet units 10 for game devices using a keyboard musical instrument, clock, athletic museum, gun and a register are also provided for malting these games realistic in comparison with that played by operating the touch pen 32.

13 Claims, 16 Drawing Sheets

TABLET UNIT

BACKGROUND OF THE INVENTION

The present invention relates to a tablet unit which is mountable on a game device in which command information is inputted by contacting a touch pen to a tablet.

As an image device typically exemplified by a video game device for children is known an image device for playing a game by loading software in the form of a picture book in a game device and watching both the picture book and a TV monitor screen.

An example of such game device is shown in FIG. 18. A video game device 12 includes a foldable game device body 14. An upper lid 18 of the game device body 14 is taken off a bottom lid 15 thereof, and a picture book-type game cartridge 22 is inserted into a cartridge slot 20 provided in the inside of the upper lid 18. Four direction buttons 24 and an execution button 26 are provided on the left side of the inside of the bottom lid 16 of the game device body 14. Four direction buttons 24 and one execution button 26 are disposed on the left side of the inside of the bottom lid 16, a tablet 28 is disposed on the center thereof, and a touch pen holder 30 is disposed on the right side of the inside thereof. The four direction buttons 24 are an upward direction button 24*a*, a downward button 24*b*, a right button 24*c* and a left direction button 24*d*, which are arranged in a cross-shape.

The direction button 24 and the execution button 26 are operated by an operator, and the operator commands four upward, downward, left and right directions by the direction button 24 and gives an execution command by the execution button 26. The touch pen holder 30 holds a touch pen 32. The touch pen 32 is contacted to a picture book of a game cartridge 22 and the tablet 28 to operate the picture book software. The tablet 28 detects by the electromagnetic induction method a position where the touch pen 32 is near the tablet. As described in Japanese Patent-Laid Open Publication No. Tokkai Hei 05-137846/1993, the electromagnetic induction method detects a position by detecting an electromagnetic signal supplied by the tablet 28 by the touch pen 32.

On the center of the inside of the upper lid 18 of the game device body 14 there is provided a picture book mount unit 34 where a picture book-type game cartridge 22 is mounted at the center thereof. The picture book mount unit 34 detects by the electromagnetic induction method, as does the tablet 28, a position where the touch pen 32 is near the picture book.

As described above, in the video game device 12 using picture book software, a required part of the picture is touched by the touch pen 32 to replace a game display on the monitor screen, or a required part of a game display is touched by the touch pen to play various games. By tracing the tablet 28 by the touch pen 32 as in drawing a picture with a paintbrush, pictures can be drawn freely on the monitor screen.

However, in the above-described video game device 12, when a car driving game is displayed on a game display, the touch pen 32 must be operated to, e.g., command a driving direction of the car. This gives no feeling of driving a car and makes the simulated operation unrealistic, and the game is unsatisfactory as a simulated experience play for children.

SUMMARY OF THE INVENTION

An object of the present invention is to provide a tablet unit which realizes simulation operations which have been impossible by operation of the touch pen to enable simulated experience plays for children.

The above-described object is achieved by a tablet unit which is mountable on a game device in which information is inputted by contacting a touch pen to a tablet, comprising: a unit body to be mounted on the game device so as to cover the tablet; contact means to be connected to the touch pen, for contacting the tablet; and operating means for operating the contact means so as to change a contact position of the contact means contacting the tablet, the contact means connected to the touch pen being contacted to the tablet to input command information in the game device.

In the above-described tablet unit it is possible that the unit body imitates a dashboard; and the operating means includes at least a handle, an ignition key and a shift lever.

In the above-described tablet unit it is possible that the unit body imitates a keyboard musical instrument; the operating means includes at least a plurality of keys; and the contact means is provided for each of said a plurality of keys.

In the above-described tablet unit it is possible that the unit body imitates a clock; and the operating means includes at least a clock needle to be rotated by an operator; and the contact means is disposed on the clock needle.

In the above-described tablet unit it is possible that the unit body imitates an athletic museum; the operating means includes at least a doll athlete which can be moved by an operator in the athletic museum.

The above-described object is achieved by a tablet unit which is mountable on a game device in which information is inputted by contacting a touch pen to a tablet, comprising: a unit body to be mounted on the game device so as to cover the tablet; holding means disposed in the unit body, for holding the touch pen movably with respect to the tablet; and operating means for operating the holding means to change a contact position of the holding means contacting the tablet, the touch pen held by the holding means being contacted to the tablet to input command information in the game device.

In the above-described tablet unit it is possible that the unit body imitates a gun; and the operating means includes at least a trigger button of the gun.

In the above-described tablet unit it is possible that the unit body imitates a bar code register; and the operating means includes at least a bar code reader.

As described above, the present invention provides a separate tablet unit to a video game device, which comprises a unit body, information inputting means and operating means, whereby information input is enabled not only by conventionally operating a touch pen alone, but also by operating the operating means, whereby the operating means and the unit body are allowed to have forms suitable for image contents of game software, e.g., a handle, a dashboard, etc. for a car game, which can make the game realistic for game players.

According to the present invention, the tablet unit to be mounted on an image device comprises a tablet body which can be mounted on the image device and covers the tablet, touch pen holding unit for holding the touch pen movably with respect to the tablet, and operation unit for moving the touch pen holder unit with respect to the tablet, whereby the operation unit and the unit body can have forms suitable for image contents, which makes games realistic for game players.

BRIEF DESCRIPTION OF THE DRAWINGS

FIG. 18 is a view of an appearance of a video game device the present invention is applicable to.

DETAILED DESCRIPTION OF THE INVENTION

A First Embodiment: Vehicle Tablet

The tablet unit for car games according to a first embodiment of the present invention will be explained with reference to FIGS. 1 to 5.

Figure 1:
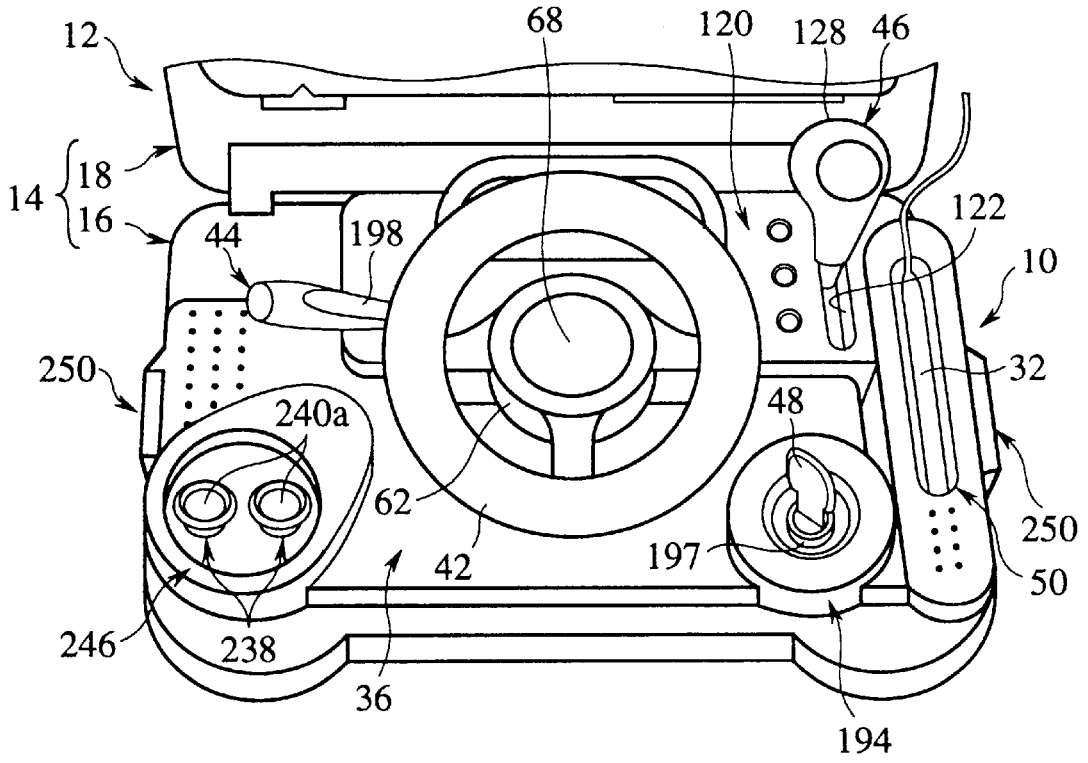
FIG. 1 is a perspective view of an appearance of the car tablet unit according to a first embodiment of the present invention.
Figure 2:
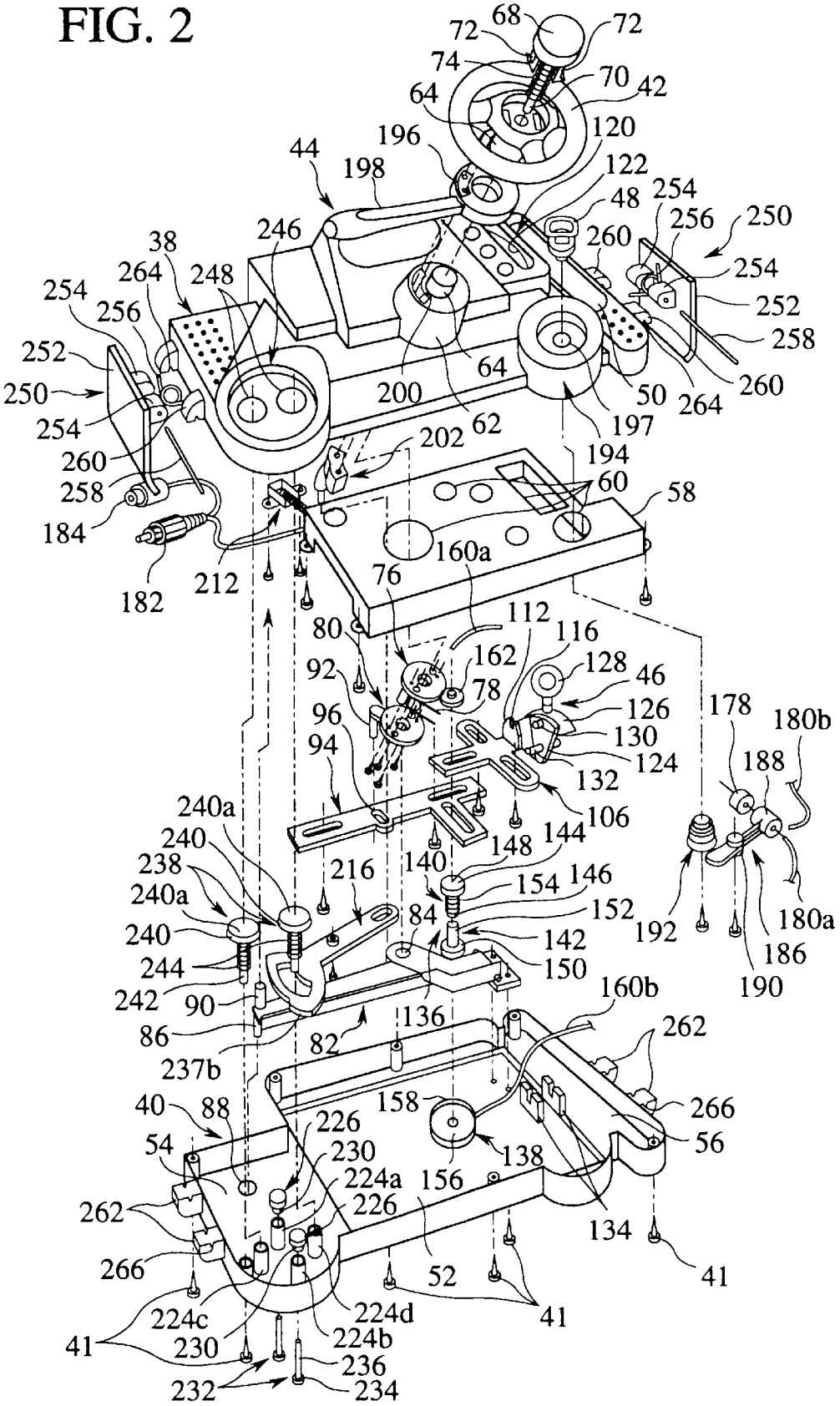
FIG. 2 is a broken perspective view of the car tablet unit.
Figure 3:
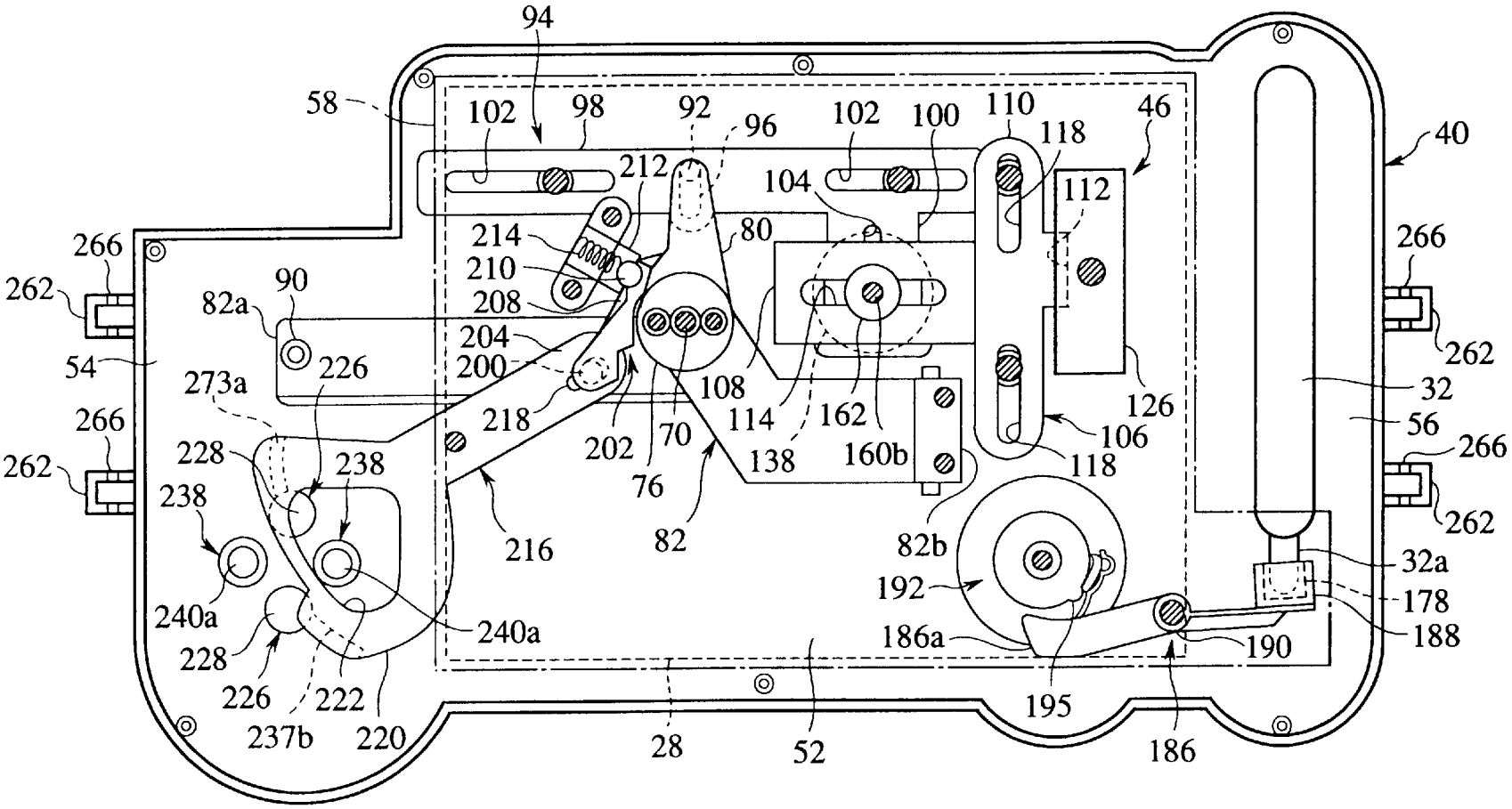
FIG. 3 is a plan view of the car tablet unit, which shows an internal structure thereof.

FIG. 1 is a perspective view of the tablet unit mounted on a video game device. FIG. 2 is a broken structural view of the tablet unit. FIG. 3 is an explanatory view of an internal structure of the tablet unit.

As shown in FIG. 1, the tablet unit for a car 10, which is the tablet unit includes a body 36 formed like a dashboard of the car and is to be mounted on a video game device 12, an image device.

As shown in FIG. 2, the body 36 is formed in the shape of a box which is a set of an upper body 38 of the body and a lower body 40 thereof.

The upper body 38 comprises an operation unit including a handle 42, a direction command lever 44, a shift lever 46, an ignition key 48, etc., and a pen holding unit 50 for holding a touch pen 32 (see FIG. 1). The lower body 40 comprises a tablet opposed surface 52 which covers the tablet 28 shown in FIG. 18 and is positioned on a bottom lid 16 of a game device body 14, a button opposed surface 54 positioned on a direction button 24 and an execution button 26, and a holder opposed surface 56 positioned on the touch pen holder 30. The upper body 38 and the lower body 40 are castings of a resin. The upper body 38 and the lower body 40 are screw-assembled. For the screw-assembling, flat screws 41 with washers are used.

As shown in FIGS. 2 and 3, an interior space defined by the upper body 38 and the lower body 40 assembled together accommodates a sealed cover 58 of metal in the shape of a box having the bottom surface opened. The sealed cover 58 accommodated in the interior space covers an interior space containing the substantially entire tablet opposed surface 52 and a part of the holder opposed surface 56. A plurality of member connection holes 60 are opened in the sealed cover 58. Through the member connection holes 60 the members outside and inside the sealed cover 58 are connected to each other (see FIG. 3).

The handle 42 is mounted on a handle mount 62 projected substantially at the center of the upper surface of the upper body 38. The handle 42 is formed in a ring shape having a rotary base 64 at the center thereof. The rotary base 64 is rotatably inserted in a base receiver 66 of a handle mount 62. The rotary base 64 permits the handle 42 to be freely rotated with respect to the handle mount 62.

A KLAXON (an electrically operated horn or warning signal) 68 is mounted on the upper surface of the rotary base 64 has a rod-shaped operative portion 70 and a pair of locking portions 72 formed on the backside of the KLAXON 68. The handle 42 is locked to the locking portions 72 by coiled spring provided urged on the outside of the operative portion 70 to thereby mount the KLAXON 68 capable of being pressed down with respect to the handle 42. The KLAXON 68 mounted on the handle 42 has the operative portion 70 passed through the handle mount 62 and projected into the interior space in the sealed cover 58.

The operative portion 70 projected in the interior space abuts upon a KLAXON arm extended along the tablet opposed surface 52 through the receiver 76, a spring 78 for neutralizing the handle and a rotary portion 80 (see FIG. 2).

The KLAXON arm 82 is formed in a strip-shape and has one end 82*b* thereof journalled to the upper body 38 so that the other end 82*a* thereof is movable to and from the lower body 40. An abutment portion 84 for the forward end of the operative portion to abut upon is provided on the substantially longitudinal middle part of the KLAXON arm 82. A rod-shaped projection 86 is formed on the backside of one end 82*a*. The projection 86 is located on an execution button hole 88 in the button opposed surface 54. The execution button hole 88 is provided on the execution button 26 of the game device body 14. One end 82*a* of the KLAXON arm 82 is normally pulled up to the inside of the upper body 38 by a tension spring 90 mounted on the upper surface thereof 82*a*. When the operative portion 70 is pressed down, one end 82*a* of the KLAXON arm 82 is pressed down against urging force of the tension spring 90, and the projection 86 is passed through the execution button hole 88 and presses down the execution button 26.

Thus, by pressing down the KLAXON 68, the execution button 26 can be turned on.

The receiver 76 and the rotary portion 80 are respectively formed in the shape of a disc having a through-hole in the center thereof, and are secured by screws respectively to the handle 42 and the receiver 76. The rotary portion 80 is fixed to the receiver 76, whereby the spring 78 for neutralizing the handle is integrated with the receiver 76 and the rotary portion 80. The spring 78 for neutralizing the handle exerts urging force against rotation of the receiver 76 and the rotary portion 80. The urging force returns the handle 42 to its neutral position when no operational force is exerted to the handle 42.

The rotary portion 80 has a locking pawl 92 projected from a peripheral portion thereof sideways and downward. The locking pawl 92 is engaged in a locking hole 96 in a handle arm 94. The handle arm 94 is interlocked with the handle 42 through the locking pawl 92.

The handle arm 94 has a substantially T-shape including a transverse plate 98 and a perpendicular plate 100 extended from a part of the transverse plate 98 nearer to one end thereof and is disposed horizontal with respect to the tablet opposed surface 52. The transverse plate 98 has a slot-shaped locking hole 96 opened widthwise in the substantially central part thereof, and two slot-shaped mounting holes 102 respectively opened lengthwise in both end portions thereof. The perpendicular plate 100 has a slot-shaped slide hole 104 opened lengthwise. The handle arm 94 is slidably screw-engaged with the upper body 38 through both mounting holes 102 with the transverse plate 98 positioned substantially parallel with longer sides of the tablet opposed surface 52.

Thus, by operating the handle 42, the rotary portion 80 is rotated together with the receiver 76, and the rotation of the rotary portion 90 reciprocates through the locking pawl 92 the handle arm 94 along the longer sides of the tablet opposed surface 52.

A shift lever arm 106 is positioned on the perpendicular plate 100 of the handle arm 94.

The shift lever arm 106 has a substantial cross-shape including a transverse plate 108 and a perpendicular plate 110 with respect to the transverse plate 108, and has a bent portion 112 on one end portion thereof which is bent upward near the intersection. A slot-shaped slide hole 114 is opened lengthwise in the other end portion of the transverse plate 108. The bent portion 112 has a recess 116 opened in the upper end thereof. The transverse plate 110 has two slot-shaped mount holes 118 opened lengthwise in both end portions thereof. The shift lever arm 106 is slidably secured to the upper body 38 by screws through both mount holes 118 with the perpendicular plate 110 positioned substantially parallel with the shorter sides of the tablet opposed surface 52.

A locking projection 130 of the shift lever 46, which will be explained later is engaged in the recess 116 of the bent portion 112, and shift lever arm 106 is interlocked with the shift lever 46 through the bent portion 112.

The shift lever 46 is mounted on a shift lever mount 120 provided on a side of the upper surface of the upper body 38. The shift lever mount 120 has an elongate groove extended from the rear to the front of the upper body 38. The shift lever 46 has a swing member 124 and a knob 128 projected from a cover 126 on the upper end of the swing member 124. A locking projection 130 is projected from an upper part of the swing member 124 and a swing shaft 132 projected below the locking projection, spaced therefrom. The swing shaft 132 is swingably received by a bearing 134 formed on the tablet opposed surface 52 of the lower body 40. The swing shaft 132 is received by the bearing 134 with the locking projection 130 engaged in the recess 116 in the bent portion 112. The swing shaft 132 is received by the bearing 134, whereby the knob 128 projected through the opening 122 is movable to-and-fro along the opening 122.

Thus, the shift lever 46 is operated by holding the knob 128, whereby the swing member 124 is swung on the swing shaft 132, and the swing of the swing member 124 reciprocates the shift lever arm 106 through the locking projection 130 along the shorter sides of the tablet opposed surface 52.

When the shift lever arm 106 is reciprocated, the transverse plate 108 of the shift lever arm 106 slides on the perpendicular plate 100 of the handle arm 94. A receiving antenna 138 is mounted through an antenna mount 136 on the backside of the perpendicular plate 100 of the handle arm 138.

The antenna mount 136 includes a spring mount 140 and a receiver 142. The spring mount 140 includes a disc portion 144 and a shaft 146 projected from the backside of the disc portion 144, and a through-hole 148 is formed in the disc portion 144 and the shaft 146. The receiver 142 includes a disc portion 150 and cylindrical portion 152 projected from the upper surface of the disc portion 150, and a through-hole communicating with the cylindrical portion 152 is opened in the disc portion 152 (not shown). The shaft 145 with a coil spring 154 mounted on can be inserted into the cylindrical portion 152.

The receiving antenna 138 is formed of a metal plate including an about 35 mm-diameter disc 156 and an about 5 mm-height wall erected around the disc 156. Two antenna cables 160*a*, 160*b* are attached respectively to the disc 156 and the wall 158. By leading out the two antenna cables 160*a*, 160*b* from the disc 156 and the wall 158, the receiving antenna 138 can have an effective receiving area as large as possible.

The antenna cable 160*a* attached to the substantial center of the disc 156 is passed through the receiver 142 and the spring mount 140, next through the antenna mount 136, further through the slide hole 104 in the handle arm 94 and the slide hole 114 in the shift lever arm 106, and then through a cable receiver 162 positioned on the transverse plate 108 of the shift lever arm 106. The antenna mount 136 the antenna cable 160 is passed through is disposed substantially vertical to the tablet opposed surface 52 so that the antenna cable 160 is invulnerable to influence of electromagnetic waves.

When the upper body 38 and the lower body 40 are assembled, the antenna mount 136 and the receiving antenna 138 are positioned between the handle arm 94 and the tablet opposed surface 52 of the lower body 40. In the antenna mount 136 the coil spring 154 is mounted on the shaft 146 of the spring mount, and the shaft 146 is inserted in the cylindrical portion 152 of the receiver 142. Thus the receiving antenna 138 located between the disc portion 150 on the lower end of the cylindrical portion 152 and the tablet opposed surface 52 is normally pressed against the tablet opposed surface 52 by urging force of the coil spring 154.

Figure 4:
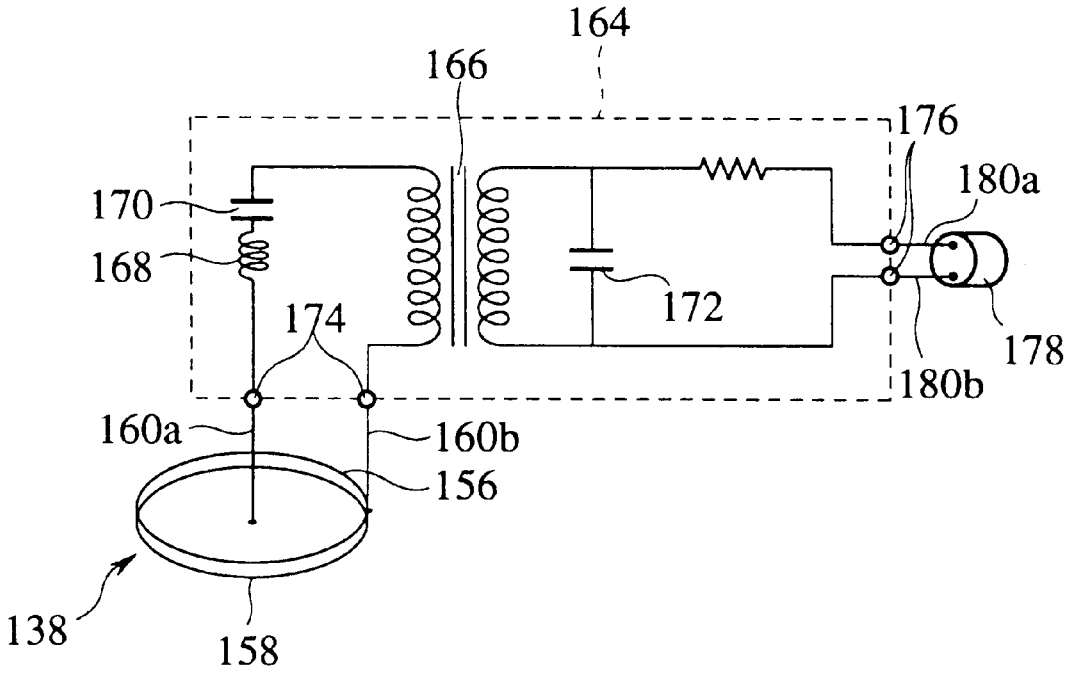
FIG. 4 is circuit diagram of noise reduction circuit of the car tablet unit.

As shown in FIG. 4, by operation of the handle 42, the receiving antenna 138 is slided on the tablet opposed surface 52 through the handle arm 94, and is slided on the tablet opposed surface 52 through the shift lever arm 106 by operation of the shift lever 46. When the handle 42 is operated, the handle arm 94 is moved in a range of the slide hole 114 in the shift lever arm 106, and the shift lever arm 106 is moved in a range of the slide hole 104 in the handle arm 94.

The two antenna cables 160*a*, 160*b* led from the receiving antenna 138 are connected to a noise reduction circuit 164.

The noise reduction circuit 164 includes an intermediate frequency transducer 166 for 455 kHz. The primary side of the intermediate frequency transducer 166 constitutes a serial oscillation circuit having an oscillation point at 455 kHz by a coil 168 and a condenser 170, and the secondary side of the intermediate frequency transducer 166 constitutes a parallel oscillation circuit having an oscillation point at 455 kHz by a condenser 172. The noise reduction circuit 164 is disposed in the body 36.

Two antenna cables 160*a*, 160*b* are connected to an input terminal 174 of the noise reduction circuit 164, and two antenna cables 180*a*, 180*b* led from the antenna on the pen are connected to the output terminal 176 of the noise reduction circuit 164. The antenna cables 160*a*, 160*b*, 180*a*, 180*b* must be spaced from the sealed cover 58 by at least 10 mm for the prevention of influence by receiving sensitivity and induced noises. A ground plug 182 connected to the sealed cover 58 is connected to either of an image output terminal of the game device body 14 and an audio output terminal (not shown) thereof for grounding. The plug 182 has a jack 184 which is the image output terminal or the audio output terminal of the game device body 14.

The noise reduction circuit 164, and the sealed cover 58 covering the noise reduction circuit 164, the receiving antenna 138, the antenna 178 on the touch pen and the antenna cables 160*a*, 160*b* can reduce influence of external noises, such as induced noises from human bodies, electromagnetic waves from home electric apparatuses, specifically electronic ranges, personal computers, television picture tubes, etc., electromagnetic waves of radio communication, etc. To obtain good sensitivity of the receiving antenna 138 it is preferable that the tablet opposed surface 52 is formed of a resin containing no carbon.

The antenna on the touch pen 178 is formed of metal in a cup-shape which embraces the tip of the touch pen 32 and is mounted on a key arm 186. The key arm 186 is formed in a strip shape and has the pen receiver 188 on one end. The pen receiver 188 is positioned in the pen holder unit 50 and accommodates the antenna 178 on the touch pen. A pin 190 is provided in the substantial lengthwise center of the key arm 186, and the pin is rotatably screw-engaged in the upper body 38.

A cylindrical key receiver 192 is provided adjacent to the key arm 186. The key receiver 192 is mounted on an ignition key 48 mounted on a key mount 194 formed in the upper body 38. The lower end portion of the ignition key 48 mounted on the key mount 194 is projected through a hole 196 in the key mount 194 beyond the backside of the upper body 38. To the lower end portion is screw-engaged with the key receiver 192. The key receiver 192 screw-engaged with the ignition key 48 is rotated circumferentially in accordance with rotation of the ignition key 48. The other end 186*a* of the key arm 186 is in contact with the outer circumferential surface of the key receiver 192. On a part of the outer circumference of the key receiver 192 there is formed an operational convexity 195 on which the other end 186*a* of the key arm 186 goes up when the key receiver 192 is rotated.

When the key receiver 192 is rotated, and the other end 186*a* of the key arm 186 goes up from the outer circumference onto the operational convexity 195, the key arm 186 is swung on the pin 190. When the key arm 186 is swung, the pen receiver 188 accommodating the antenna 178 on the touch pen with the tip inserted in is moved in direction of pressing down the tip of the touch pen.

A direction command lever 44 is mounted on the base receiver 66 of the handle mount 62. The direction command lever 44 includes a ring-shaped lever base 196, and an operational portion 198 projected over the outer circumference of the lever base 196. The lever base 196 is mounted on the outside of a base receiver 66 rotatable with respect to the base receiver 66. A secular recess 200 is formed beside the base receiver 66.

A lever connector 202 is mounted on the underside of the lever base 196 of the direction command lever 44 from the recess 200 into the interior space. The lever connector 202 includes a click in the shape of an arc which conforms to a shape of the recess 200, and a connection rod 206 projected from the lower end of the click 204. The click is secured by a screw to the lever base 196. The lever connector 202 is moved in the recess 200 together with the direction command lever 44, which is swung on the base receiver 66. A movement range of the lever connector 202 moved in the recess 200 is a swing range of the direction command lever 44. Three vertical grooves 208 are formed in the outer circumferential surface of the click 204. A ball receiver 212 having a click ball 210 is provided outside the click 204. The click ball 210 is urged by a coil spring 214 to be licked with the grooves 208.

Thus, the direction command lever 44 can be displaced forward and to the foreground as viewed in the drawing from a position substantially alongside of the handle mount 62 while the click ball 210 is locked in the associated grooves, giving click feeling.

The forward end of the connection rod of the lever connector 202 is engaged in a locking hole 218 in a direction command lever arm 216 disposed along the tablet opposed surface 52 and the button opposed surface 54. The direction command lever arm 216 is formed in a strip-shape and has the locking hole 218 in one end portion and a widened portion 220 on the other end portion. The locking hole 218 is a lengthwise slot, and the widened portion 220 is formed in the shape of a ring having an opening 222. The direction command lever arm 216 has the substantially central part thereof mounted on the upper body 38 by a screw capable of being swung on the screw. Thus, the direction command lever arm 216 is interlocked with the direction command lever 44 through the forward end of the connection rod 206 locked in the locking hole 218 and the lever connector 202.

On the button opposed surface 54 where the widened portion 220 of the direction command lever arm 216 there are provided an upper button receiver 224*a*, a lower button receiver 224*b*, a left button receiver 224*c* and a right button receiver 224*d*. The button receivers 224*a*, 224*b*, 224*c*, 224*d* are arranged in a cross corresponding to the direction buttons 24*a*, 24*b*, 24*c*, 24*d* of the game device body 14. The button receivers 224*a*, 224*b*, 224*c*, 224*d* are formed in cylinders having the bottoms opened on the buttons 24*a*, 24*b*, 24*c*, 24*d* of the game device body 14.

Respective direction command buttons 226 are mounted on the upper open ends of the upper button receiver 224*a* and the lower button receiver 224*b*. The direction command button 226 includes a disc-shaped head 228 exposed through the upper open end, a rod 236 inserted at the upper open end and projected beyond the bottom surface of the head 228. Operational portions 232 are mounted on the lower open ends of the upper button receiver 224*a* and the lower button receiver 224*b*. Each operational portion includes a disc-shaped head 234 exposed through the lower open end, a rod 236 inserted at the lower open end and projected beyond the bottom surface of the head 234. The rod 230 of the direction command button 226 and the rod 230 of the operational portion 232 abut on each other, and with the head 234 of the direction command button 226 abutting on the upper open end, the head 234 of the operational portion 232 is pushed downward of the lower open end. The head 234 of the operational portion 232 is pushed out to thereby press down the upward direction button 24*a* of the game device body 14 or the downward direction button 24*b* thereof.

An upper wall 237*a* and a lower wall 237*b* are erected, spaced from each other on the underside of the forward portion of the widened portion 220 of the direction command lever arm 216. The upper wall 237*a* is positioned in a trace which is over the direction command button 226 mounted on the upper button receiver 224*a*, and the lower wall 237*b* is positioned in a trace which is over the direction command button 226 mounted on the lower button receiver 224*b*. The upper wall 237*a* and the lower wall 237*b* have a positional relationship that when the upper wall 237*a* goes on the direction command button 226, the lower wall 237*b* does not go on the direction command button 226, and the upper wall 237*a* does not go on the direction command button 226 when the lower wall 237*b* goes on the direction command button 226.

Thus, when the direction command lever 44 is positioned substantially alongside of the handle mount 62, the upper wall 237*a* and the lower wall 237*b* do not go on the direction command button 226. When the direction command lever 44 is displaced forward of the handle mount 62, the upper wall 237*a* goes on the direction command button 226 of the upper button receiver 224*a*, presses down the operational portion 232 and presses down the upper direction button 24*a* of the game device body 14. When the direction command lever 44 is displaced to the foreground of the handle mount, the lower wall 237*b* goes on the direction command button 226 of the lower button receiver 224*b*, presses down the operational portion 232 and presses down the downward button 24*b* of the game device body 14.

Respective selection buttons 238 are mounted on the upper open ends of the right button receiver 224*c* and the left button receiver 224*d*. Each selection button 238 includes a disc-shaped head 240 exposed through the upper open end, a rod 242 inserted at the upper open end and projected beyond the bottom surface of the head 240. The head 240 has a two-stage structure having a smaller-diameter upper end portion 240*a*. The forward end of the rod 242 is exposed through the lower open end. A coil spring 244 is mounted around the rod 242 between the head 240 and the upper open end. The coil spring 244 exerts to the selection button 238 urging force which is against downward press force.

When the upper body 38 is assembled with the lower body 40, the select buttons 238 are positioned on a selection button mount 246 formed on the upper body 38. The selection button mount 246 includes two receivers 248 which are in the form of openings having a size which can accommodate the upper end portions 240*a* of the heads 240 of the selection buttons 238 are formed in the selection button mount 246. The selection buttons 238 abuts on the section button mount 246 at the underside of the upper body 38 with the upper end portions 240*a* exposed through the receivers 248.

Thus, when the selection button 238 on the left side of the selection button mount 246 is pressed down, the forward end of the rod 242 presses down the left direction button 24*c*. When the selection button 238 on the right side of the selection button mount 246 is pressed down, the forward end of the rod 242 presses down the right direction button 24*d* of the game device body 14.

When the direction command lever 44 is displaced, the left button receiver 224*c* is outside a displacement range of the widened portion 220, and the right button receiver 224*d* is positioned in the opening 222 in the widened portion 220, whereby the operation of the direction command lever 44 and that of the selection button 238 do not interfere with each other.

On both sides of the body 36 there are provided fixation members 250 for fixing the car tablet unit 10 mounted on the tablet 28 to the game device body 14. Each fixation member 250 includes a rectangular clamping plate 252, and two pairs of rod mounts 254 disposed on an upper part of the inside of the clamping plate 252. The lower ends of the clamping plates 252 reach the side surfaces of the bottom lid 16. A rod 258 is mounted on each pair of rod mounts for retaining a spring 256 thereon. Both ends of each rod 258 are jutted outside of the rod mounts 254 of each pair. Both ends of each rod 258 are clamped between a pair of upper rod receivers 260 of the upper body 38 and a pair of lower rod receivers 262 on the lower body 40.

The upper rod receivers 260 of each pair are spaced from each other so that the rod mounts 254 of each pair are positioned between the rod receivers 260 of each pair, and are projected from both side surfaces of the upper body 38. Each upper rod receiver 260 has a groove for receiving the rod formed in the underside thereof. The lower rod receivers 262 of each pair are spaced from each other so that the rod mounts 254 of each pair are positioned between the rod receivers 260 of each pair, and are projected from both side surfaces of the lower body 40. Each lower rod receiver 260 has a groove for receiving the rod formed in the underside thereof.

The springs 256 are so mounted that when the upper body 38 and the lower body 40 are assembled together, the lower ends of the clamping plates 252 are urged to the body 36. The urging force of the springs 256 enables both clamping plates 252 to clamp the video game device body 14 on both sides thereof. Thus, by the fixation members 250 the car tablet unit 10 can be securely mounted on the bottom lid 16 of the video game device body 14. The tablet opposed surface 52 of the fixed car tablet unit 10 covers the tablet 28.

The car tablet unit 10 is mounted on the video game device body 14, the touch pen 32 is accommodated in the pen holder member 50, and the pen tip 32*a* is inserted in the antenna 178 on the touch pen, and the following operation is enabled.

The handle 42 or the shift lever 46 is operated to change a moving direction or a speed of a displayed car.

When the handle 42 or the shift lever 46 is operated, the receiving antenna 138 is moved over the tablet opposed surface 52. The receiving antenna 138 is pressed against the tablet opposed surface 52 in contact with the tablet 28 and receives electromagnetic waves from the tablet 28 to transmit the same to the pen tip 32*a*. The electromagnetic waves generated by the tablet 28 contain vertical Y-axis components and horizontal X-axis components, and the receiving antenna 138 receives Y-axis components and X-axis components which indicate positional coordinates of moving positions.

When the handle 42 is turned right, the receiving antenna 138 is moved right over the tablet opposed surface 52 and receives electromagnetic waves of positional coordinates of the receiving antenna 138 and transmits the same to the pen tip 32*a*. In accordance with positional coordinates transmitted to the pen tip 32*a*, a car, a display image, is moved right. When the handle 42 is turned left, the receiving antenna 138 is moved left over the tablet opposed surface 52 and receives electromagnetic waves of positional coordinates of the receiving antenna 138 and transmit the same to the pen tip 32*a*. In accordance with positional coordinates transmitted to the pen tip 32*a*, the car, a display image, is moved left. When the handle 42 is neutral, the car, a display image, is directed forward without changing a direction. When the shift lever 46 is operated, the receiving antenna 138 is moved vertically.

When the ignition key 48 is operated, the antenna 178 on the touch pen is moved, and pushes in the pen tip 23*a* of the touch pen 32 or releases the pushed-in pen tip 32*a*. By pushing in the pen tip 32*a* or releasing the pen tip 32*a*, the pen switch is turned on/off to change display images and do other function.

By operating the operational lever 44, the KLAXON 68 or the selection button 238, the car, an image display, can be operated and events are enjoyed. By operating the direction command lever 44, one of the upward direction button 24*a* of the video game device body 14 or the downward direction button 24*b* thereof can be pressed. By operating the KLAXON 68, the execution button 26 can be pressed. By operating the selection button 238, the left direction button 24*c* or the right direction button 24*d* can be pressed.

Then, a drive game using the car tablet unit will be explained.

First, the car tablet unit 10 is mounted on the video game device body 14. The touch pen 32 is accommodated in the pen holder member 50. An initial display of the drive game is displayed on the display screen.

Figure 5:
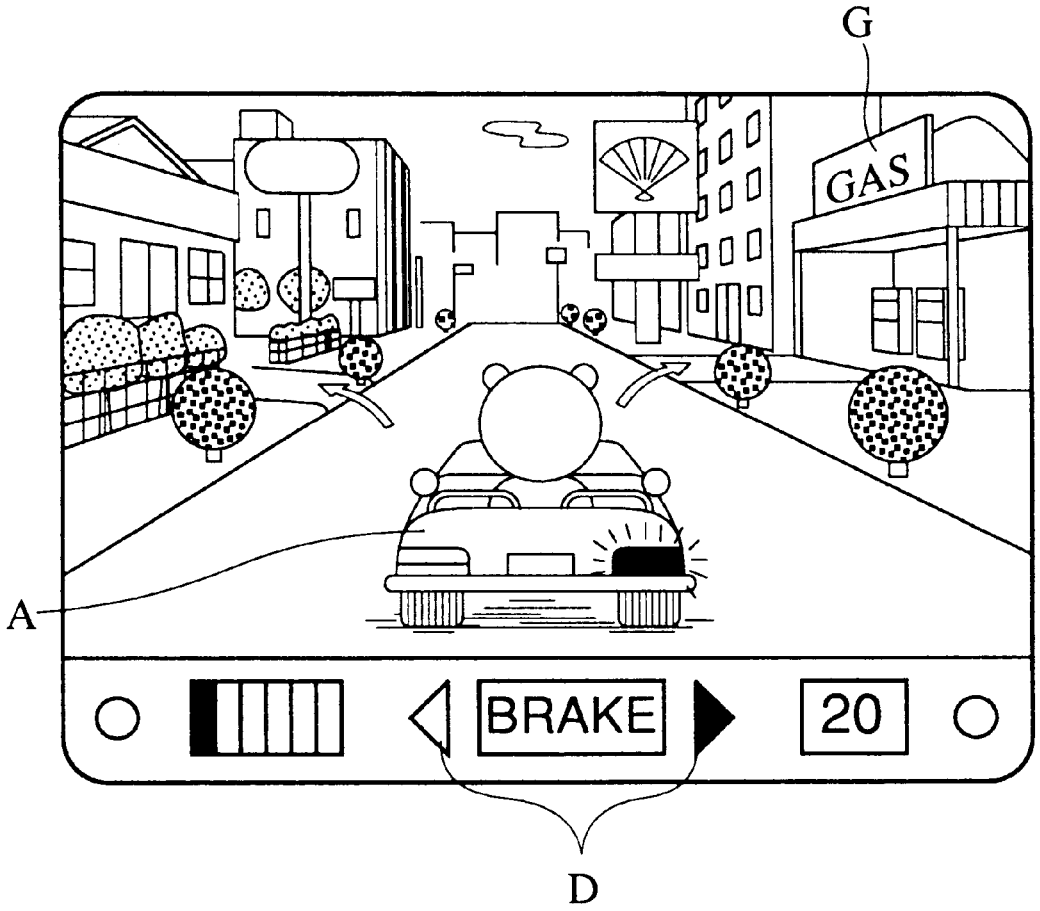
FIG. 5 is a view of an example of image monitors suitably used in the car tablet unit of FIG. 1.

Then, the ignition key 48 is operated to start the engine. When the engine is started, the car starts, and the display is changed. As shown in FIG. 5, a car A driving along a road is displayed on the display screen.

Next, the handle 42 is operated to change a direction of the car A. The handle 42 is turned left or right, and the car A changes the direction to the left or the right to which the handle 42 has been turned. The car A approaches to the shoulder of the road and enter the building of the gas station G. As a variation of this operation, the direction command lever 44 in place of the handle 42 is operated to change the direction of the car A.

When the direction command lever 44 is operated, a direction indicator D interlocked with the car A flashes. The KLAXON 68 can be operated to sound. By operating the shift lever 46, the speed of the car A can be controlled among three stages of stop, low speed and high speed. During the stop, idling sound is made, at the low speed, low-speed driving sound is made, and at the high speed, high-speed driving sound is made.

When the car A enters a building of, e.g., a gas station G, a monitor display is changed to a display of an inside of the gas station G, and events of oiling and car washing, etc., can be selected. Events can be selected and executed by operating the selection button 238, can be selected by the direction command lever 44 and executed by the selection button 238, or are selected by the handle 42 and executed by the selection button 238. Not only events, but also games, etc. can be selected and executed by the selection button 238.

Thus, without the use of the touch pen 32, the game can be played by operating the handle 42, the direction command lever 44, the shift lever 46, the ignition key 48, the KLAXON 68 and the selection button 238 of the car tablet unit 10.

Contents of the game cartridge in the video game device 12 can be directly selected by dismounting the touch pen 32 from the pen holder member 50, dismounting the antenna 178 of the touch pen and operating the touch pen 32.

As described above, according to the first embodiment of the present invention, the tablet unit includes the body in the shape of a car dashboard, and the receiving antenna 138 on the tablet 28 is operated, whereby game players can feel as if they were actually driving a car, the so-called virtual reality feeling. This makes the game itself exciting.

In the first embodiment, the tablet is in the form of the car dashboard but may be in the form of a vehicle other than a car, e.g., a bike, airplane, spaceship, submarine, boat or others.

A Second Embodiment: Keyboard Tablet

Next, a keyboard tablet which is the tablet unit according to a second embodiment of the present invention will be explained with reference to FIGS. 6 to 8.

Figure 6:
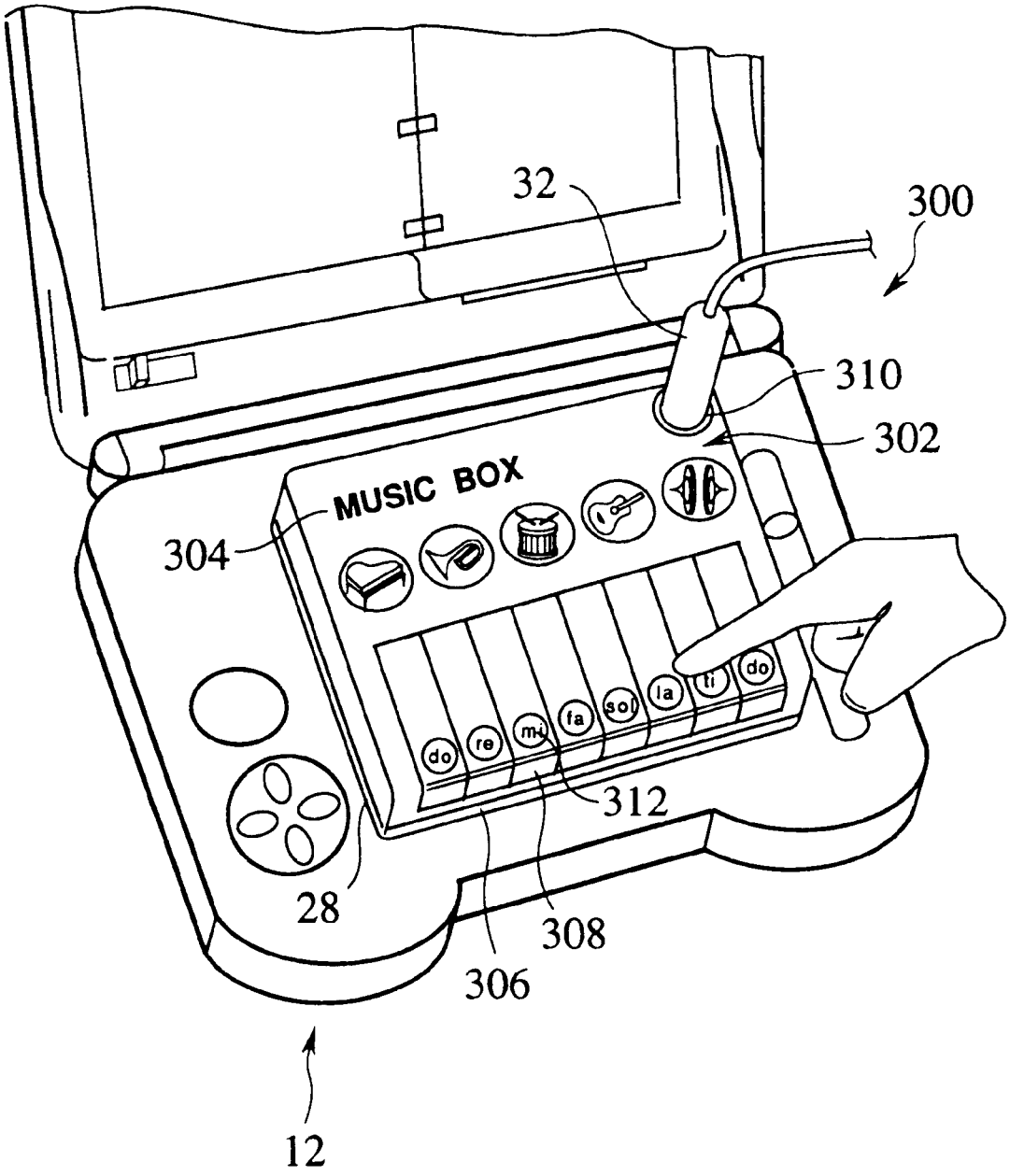
FIG. 6 is a perspective view of an appearance of the keyboard tablet unit according to a second embodiment of the present invention.

FIG. 6 is a perspective view of the keyboard tablet mounted on a video game device.

As shown in FIG. 6, the keyboard tablet 300 is mounted on a tablet 28 of the video game device 12. The tablet unit 300 includes a body 302 imitating a keyboard.

The body 302 is formed in the shape of a box which is an assembly of an upper lid 304 and a back lid 306. Eight keys 308 are arranged widthwise on the upper lid 304, and a touch pen mount hole 310 is formed therein. The back lid 306 covers the tablet 28. The keys are accommodated in the body 302 except the upper surfaces and rear end surfaces of the keys. On the upper surfaces of the keys 308, syllables 312, do, re, mi, fa, sol, la, ti, do representing the tones of the diatonic scale are written.

Figure 7:
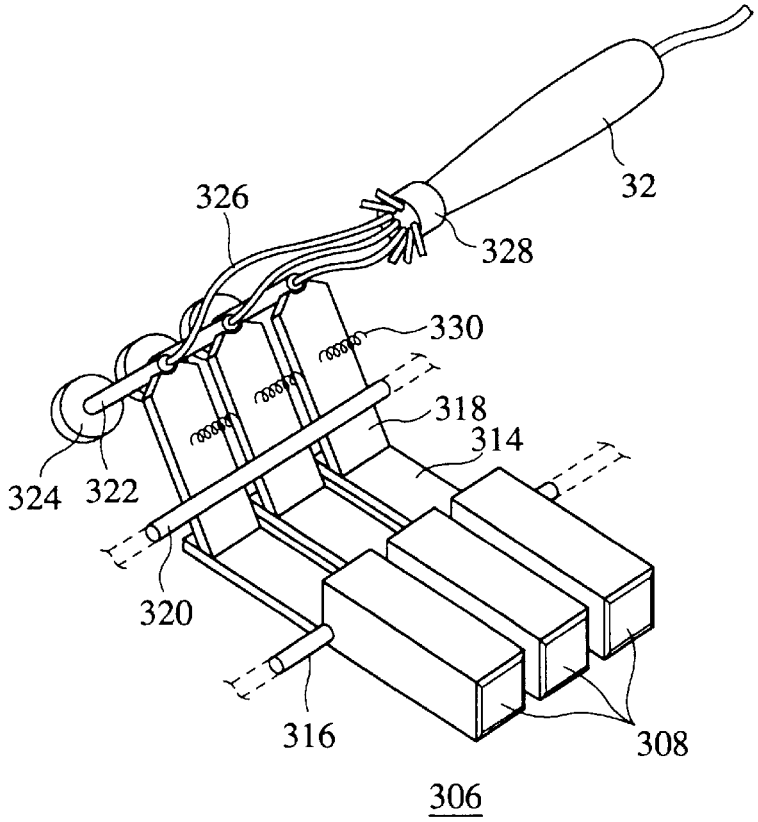
FIG. 7 is a view of an appearance of a receiving antenna driving mechanism of the tablet unit of FIG. 6.

As shown in FIG. 7, swing plates are attached to rear parts of the backsides of the keys 308 housed in the body 302. A swing pin 316 is provided on forward parts of the backsides of the keys 308. Rear ends of operational plates 318 are mounted on forward end portions of the swing plates 314. An operational plate pin 320 is provided on the upper surfaces of rear end portions of the operational plates 318. On the forward ends of the respective operational plates 318, cylindrical antenna shafts 322 are mounted inclined. Disc-shaped receiving antennas 324 are mounted on the downward ends of the respective cylindrical antenna shafts 322. The antenna shafts 322 and the receiving antennas 324 are substantially perpendicular to each other. One ends of antenna cables 326 are connected to the substantial centers of the receiving antennas 324. The antenna cables 326 are wired through the antenna shafts 322 and has the other ends connected to an antenna 328 on the touch pen.

Coil springs 330 are attached to the upper surfaces of the operational plates 318 for pulling upward the operational plates 318. To receive without erroneous operations electromagnetic waves radiated from the surface of the tablet it is preferable that the operational plates 318 are retained by the coil springs 330 when the keys 308 are not pressed so that the receiving antennas 324 are spaced by about 20 mm from the back lid 306.

The antenna 328 on the touch pen is formed of a metal in the shape of a cup which embraces the tip of the touch pen 32 as in the first embodiment, and is disposed in a touch pen mount hole (FIG. 6). To the antenna 328 on the touch pen, the eight antenna cables 326 from the receiving antennas 324 mounted on the respective keys 308 are connected to the antenna 328 on the touch pen. The tip of the touch pen 32 can be inserted in the antenna 328 on the touch pen by inserting the touch pen 32 into the touch pen mount hole 310 with the tip thereof ahead.

Next, the operation of the tablet unit 300 having the above-described structure will be explained.

First, the tablet unit 300 is mounted on the tablet 28 of the video game device 12, and the touch pen 32 is disposed in the touch pen mount hole 310. The back lid 306 of the mounted tablet unit 300 covers the tablet 28, and the tip of the touch pen 32 is inserted into the antenna on the touch pen.

Then, an arbitrary one of the keys 308 is pressed down. When the key 308 is pressed down, the forward end of the swing plate 314 associated with the pressed-down key 308 is swung upward on the key pin 316. As the tip of the swing plate 314 is swung upward, the lower end of the operational plate associated with the swing plate 314 is pushed upward, and the operational plate 318 is swung on the operational plate pin 320 as the swing fulcrum against urging force of the coil spring 330. The swing of the operational plate 318 presses the receiving antenna 324 associated with the operational plate 318 against the back lid 306.

The receiving antenna 324 pressed against the back lid 306 receives electromagnetic waves from the tablet 28 and transmits the same to the pen tip 32*a*. The electromagnetic waves from the tablet 28 contain vertical Y-axis component and horizontal X-axis component, and the receiving antenna 324 received X-axis component and a Y-axis component indicating coordinates of a place on the back lid 306 against which the operational plate 318 is pressed. Corresponding to the positional coordinates supplied to the pen tip 32*a* that of the tones associated with the pressed down key 308 is sounded.

When the key 308 is released from the press-down, the key 308 is returned to its original position by the urging force of the coil spring 330.

Figure 8:
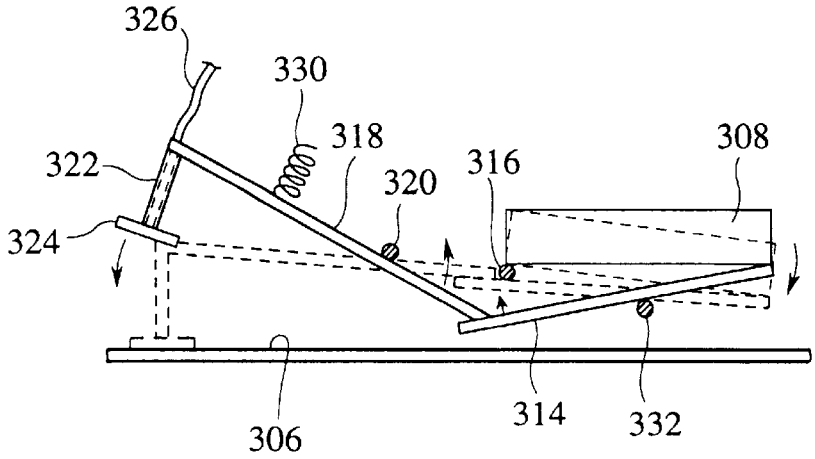
FIG. 8 is a side view of the drive mechanism of FIG. 7.

A mechanism shown in FIG. 8 may be used in pressing down a key 308 to press the associated receiving antenna 324 against the back lid 306.

In the mechanism of FIG. 8, the key swing pin 31 is disposed on the undersides of the forward end of the keys 308, and the rear ends of the swing plates 314 abut on the undersides of the rear ends (on the foreground) of the keys 308. The swing pin 332 is disposed on the underside of the substantially longitudinal center of the swing plates 314, and the rear ends of the operational plates 318 are mounted on the forward ends of the swing plates 314. The operational plate pin 320 is disposed on the upper surface of a rear end part of the operational plates 318. The receiving antennas 324 are mounted on the forward ends of the operational plates 318 through the antenna shafts 322.

The operation of the mechanism of FIG. 8 is the same as that of the mechanism of FIG. 7. When a key 308 is pressed down, the rear end of the key is swung down on the key pin 316 as the swing fulcrum, and the associated swing plate 314 is swung on the swing plate pin 332 as the swing fulcrum. As the swing plate 314 is swung with the forward end swung upward, the lower end of the associated operational plate 318 is pressed downward, whereby the associated receiving antenna 324 is pressed against the back lid 306. Information transmission from the receiving antenna 324 to the touch pen 32, and the operation upon releasing the key 308 are the same as in the mechanism of FIG. 7.

As described above, according to the second embodiment of the present invention, the tablet unit 300 gives the video game device 12 the function of a keyboard, and a plurality of receiving antennas 324 on the tablet 28 are operated by the keys 308, whereby players (children) can easily experience playing musical instruments, which is very effective from the viewpoint of emotional education.

A Third Embodiment: Clock Tablet

Then, the tablet unit in the form of a clock according to a third embodiment of the present invention will be explained with reference to FIGS. 9 and 10.

Figure 9:
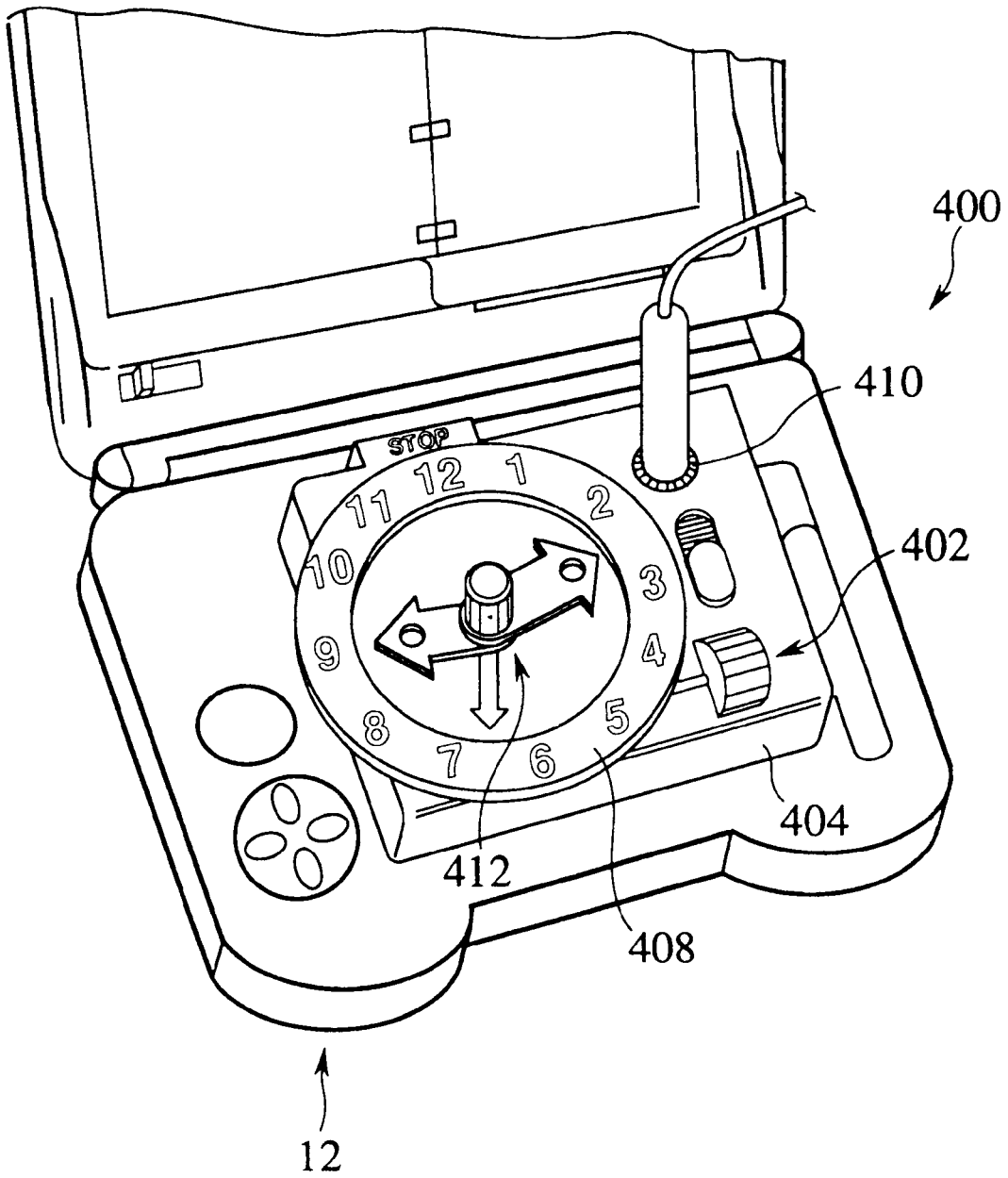
FIG. 9 is a perspective view of an appearance of a lock tablet unit according to a third embodiment of the present invention.

FIG. 9 is a perspective view of the tablet unit mounted on a video game device, which shows its state. As shown in FIG. 9, the tablet unit 400 is mounted on a tablet of the video game device 12. The tablet unit 400 includes a body 402 imitating a clock.

Figure 10A:
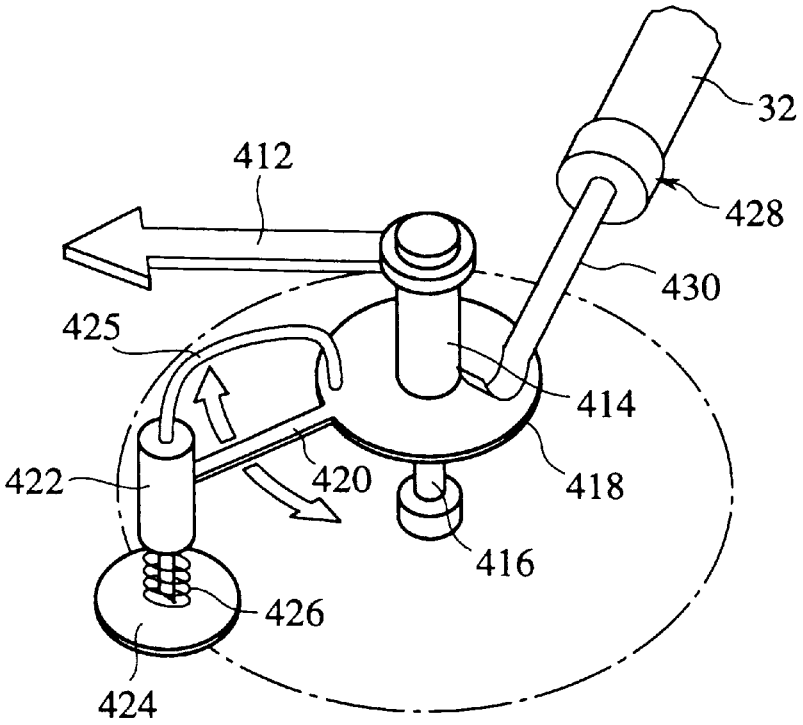
FIGS. 10A and 10B are views of a receiving antenna drive mechanism of the tablet unit of FIG. 9, FIG. 10A being a view of an appearance thereof and FIG. 10B being a view of a side appearance.
Figure 10B:
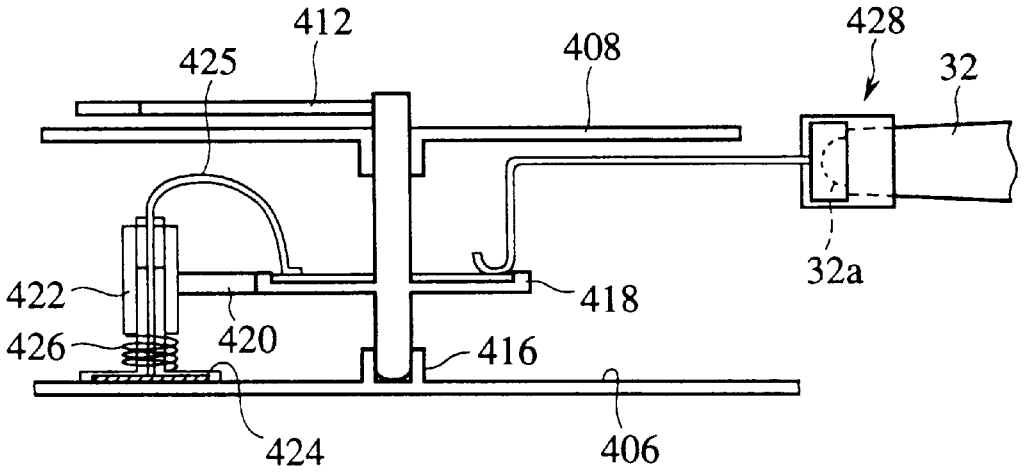
Figure 18:
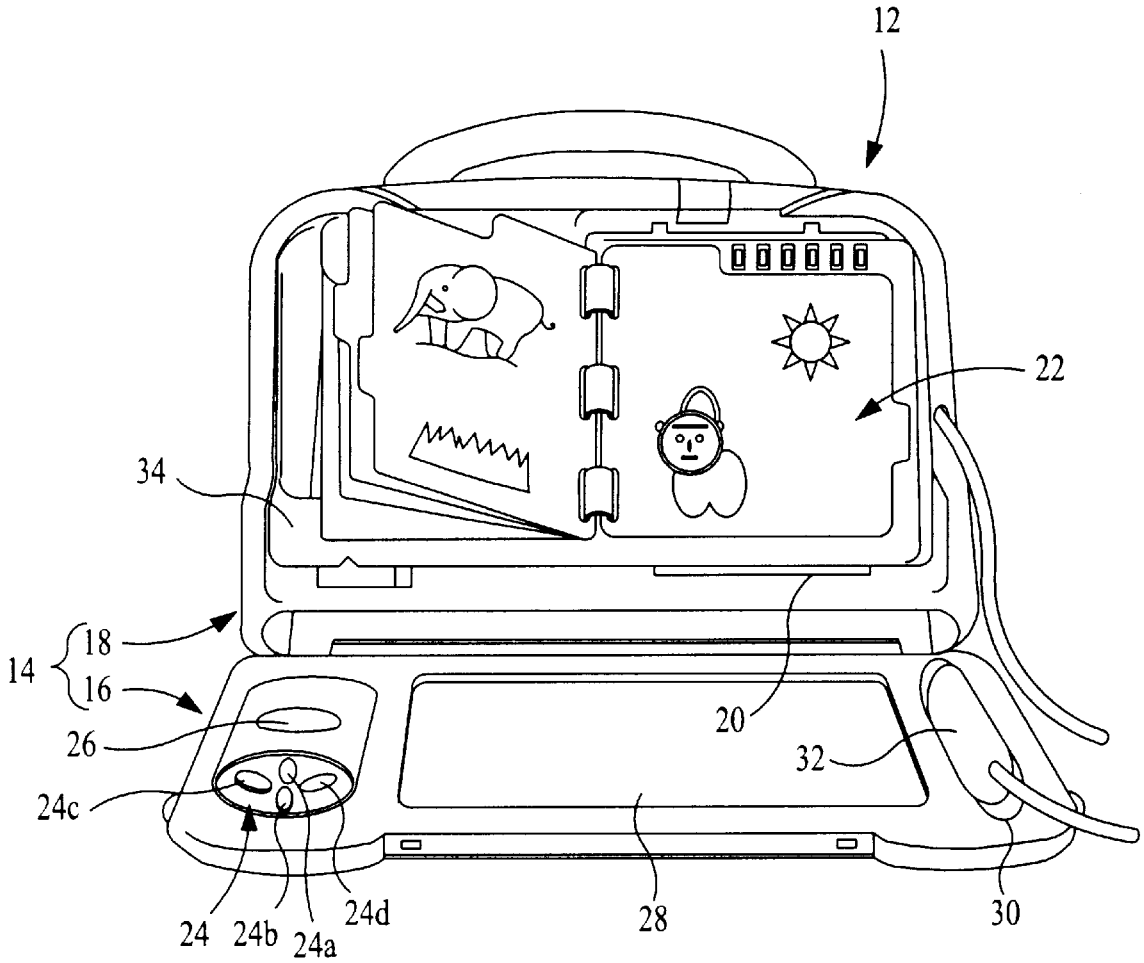
FIG. 18 PRIOR ART

The body 402 is formed in the shape of a box formed by assembling an upper lid 404 and a back lid 406 (FIG. 10). A dial 408 and a touch pen mount 410 are disposed on the upper lid 404. The back lid 406 covers the tablet 28 (FIG. 18). Needles (long, short and second needles) 412 which can be rotated to an arbitrary position by a player are disposed on the dial 408.

As shown in FIG. 10A, the needles 412, for example, is secured to an end portion of a short needle shaft 414 passed through the dial 408, and the short needle shaft 414 is rotatably mounted on the back lid 406 rotatably by a bearing 416. The short needle shaft 414 further includes a circular metal plate 418 integrated therewith on the dial 408. A support arm 420 is extended radially outward from the metal plate 418 at a position opposed to the short needle 412. The antenna support arm 420 secures on the forward end a cylinder 422 opened toward the back lid 406. The cylinder 422 is inserted into a tappet-shaped receiving antenna 424 through a compression spring 426. The coil spring 426 urges the receiving antenna 424 against the back lid 406, so that the receiving antenna 424 can efficiently receive electromagnetic waves from the tablet 28. One end of an antenna cable 425 is connected substantially to the center of the receiving antenna 424. The antenna cable 425 is wired through the shaft of the receiving antenna, and the other end of the cable 425 is connected to the metal plate 418.

The antenna on the touch pen is formed in the shape of a cup of metal as in the above-described embodiments, and is disposed in a touch pen mount hole 410 (FIG. 9). To the antenna 428 on the touch pen there is connected a strip-shaped antenna cable 430 which friction-contacts a rotary metal plate 418 to supply to the antenna 428 on the touch pen information transmitted from the receiving antenna 424 to the metal plate 418 through the cable. The touch pen 32 has the tip inserted in the antenna 428 on the touch pen by inserting the touch pen into the touch pen mount hole 410 with the tip ahead.

Then, the tablet unit 400 having the above-described structure will be explained.

First, the tablet unit 400 is mounted on the tablet 28 of the video device 12, and the touch pen 32 is disposed in the touch pen mount hole 410. The back lid 406 of the mounted tablet unit 400 covers the tablet 28, and the tip of the touch pen 32 is inserted into the antenna 428 on the touch pen.

In this state, a player rotates the needle 412 to a required position in accordance with a command of the image monitor. When the needle 412 is rotated, the metal plate 418 is rotated on the bearing 416, and in accordance with this, the receiving antenna 424 is rotated to the required position on the back lid 406.

The receiving antenna 424 pressed against the back lid 406 at the required position receives electromagnetic waves from the tablet 28 and transmits positional information of the position to the tip 32*a* of the touch pen 32 through the antenna cable 425, the metal plate 418 and the antenna cable 430. The electromagnetic waves generated by the tablet 28 contain vertical Y-axis component and horizontal x-axis component, and the receiving antenna 424 receives x-axis components and y-axis components indicative of positional coordinates of the position on the back lid 406 to which the receiving antenna is contacted. Based on the positional coordinates transmitted to the pen tip 32*a*, the video game device 12 compares needle position information inputted by, e.g., the touch pen 32 with a time commanded to the monitor, and in accordance with a comparison result, correct or incorrect, a prescribed image or chimes are outputted.

Thus, according to the third embodiment of the present invention, the tablet unit 400 gives the video game device 12 a function of a toy clock, and the receiving antenna 42 on the tablet 28 is operated by the needle 412, whereby players (children) can physically learn the mechanism and characteristics of the clock. The present embodiment can achieve sufficient advantageous effect in terms of emotional education. In the third embodiment, the mechanism is described by using the short needle, but it is possible that the receiving antenna 424 can be driven in a more sophisticated manner by using the long and the short needles.

A Fourth Embodiment: Tablet for Soccer Game

Figure 11:
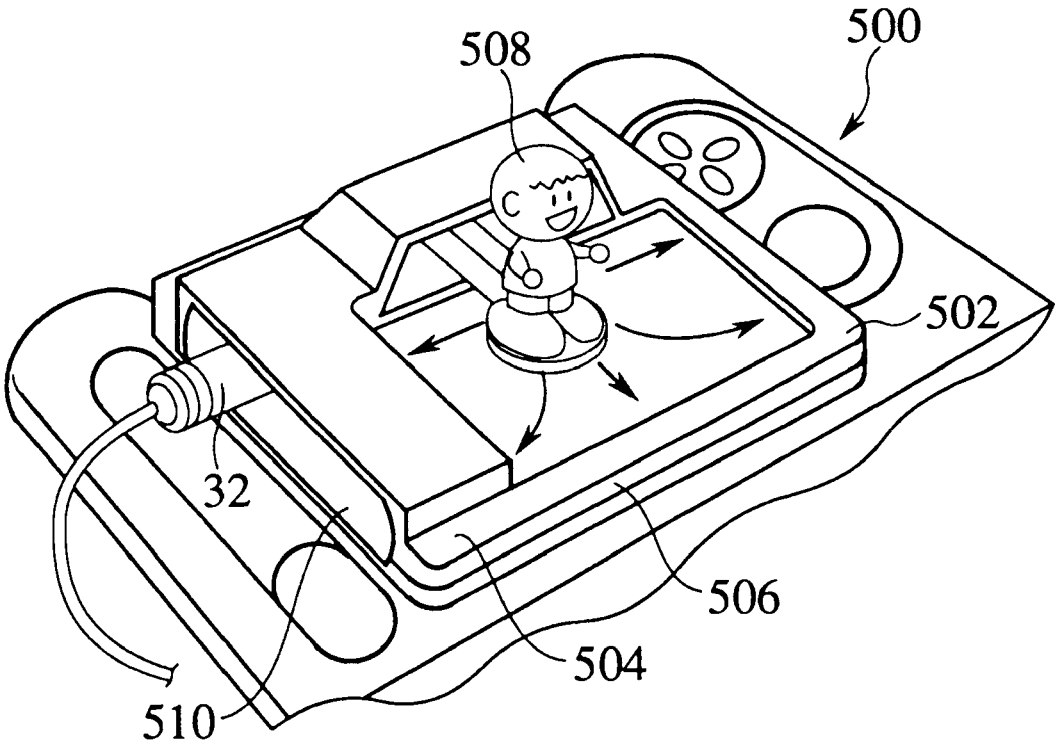
FIG. 11 is a perspective view of an appearance of a soccer tablet unit according to a fourth embodiment of the present invention.

The tablet for a soccer game according to the fourth embodiment of the present invention will be explained with reference to FIGS. 11 and 12.

In the above-described first to the third embodiments, the touch pen 32 is inserted in the touch pen mount hole, and positional information received by the receiving antenna is transmitted to the touch pen 32 through the cable. However, it is possible that the touch pen 32 itself is made movable by securing the touch pen to a movable formed object, and electromagnetic waves from the tablet surface are directly received by the touch pen.

In the present embodiment, a doll which is an operation unit, and a touch pen are interlocked so that the touch pen 32 is directly moved by operating the doll. As shown in FIG. 11, the tablet unit 500 is mounted on the tablet of the video game device 12. The tablet unit 500 includes a body 502 imitating a soccer field.

The body 502 is formed in the shape of a box formed by assembling an upper lid 504 and a back lid 506. On the upper lid 504 a soccer player (e.g., a goal keeper) 508 which is a controller for a player is disposed movably in the directions of the arrows. A touch pen mount opening 510 is formed in a side of the body 502. The back lid 506 covers the tablet 28 (FIG. 18).

Figure 12:
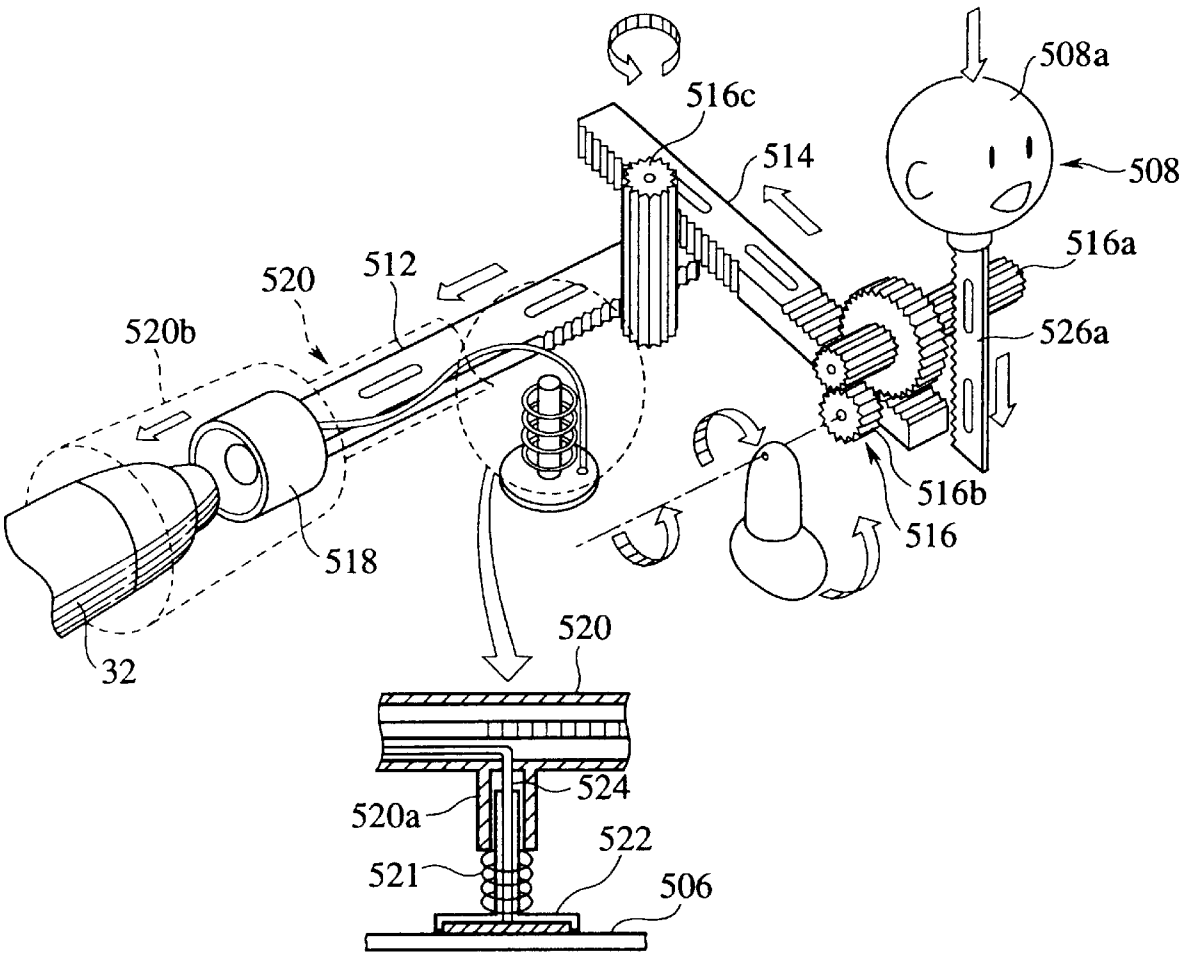
FIG. 12 is a view of an appearance of a touch pen drive mechanism of the tablet unit of FIG. 11.

As shown in FIG. 12, the goal keeper 508 and the touch pen 32 normally intersects each other, and are interlocked with each other by a horizontal lever 512 which is longitudinally movable, a vertical lever 514 and a gear assembly 516. A pen socket 518 is secured to one end of the horizontal lever 512. The pen socket 518 is capable of contacting a tip 32*a* of the touch pen 32 inserted in the body through the touch pen mount opening 510. The horizontal lever 512 is housed longitudinally displaceable in a lever cover 520 a partial section of which is shown in the drawing. A cylindrical antenna shaft 520*a* is suspended from the underside of the lever cover 520 downward to the back lid 506. A pen holder 520*b* for holding the forward end of the inserted touch pen 32 is provided on the end of the lever cover 520.

A receiving antenna 522 is vertically movably inserted in the antenna shaft 520*a* through a spring 521. An antenna cable 524 extended from the pen socket 518 is connected to the substantial center of the receiving antenna 522. The antenna cable 524 is wired through the lever cover 520. The operation of the tablet unit 500 having the above-described structure will be explained.

First, the tablet unit 500 is mounted on the tablet 28 of the video game device 12, and the touch pen 32 is securely inserted in the pen holder 520*b*. The back lid 506 of the tablet unit 500 covers the tablet 28.

In this state, a game player presses down the head 508*a* of the goal keeper 508 toward the tablet 28 (in the direction of the arrow). When the head 508*a* is pressed down, a core member 526 integrated with the head 508*a* rotates pinion gears 516*a*, 516*b*, whereby the legs 508*b* of the goal keeper interlocked with the pinion gear 516*b* is rotated in a manner like licking a ball. The rotation of the pinion gear 516*a* moves the vertical lever 514 in the direction of the arrow, and the movement displaces through the gear 516*c* the horizontal lever 512 in the direction of the arrow. As a result, the pen socket 518 on the forward end of the lever is brought into contact with the pen tip 22*a*, and positional information of a position of the receiving antenna 522 is transmitted to the touch pen 32.

In the game, the game player presses down the head 508*a* of the goal keeper 508 to move the goal keeper horizontally and vertically on the tablet, whereby the game player blocks shoots displayed on the monitor or kicks the ball to the opponent's goal.

As described above, according to the fourth embodiment of the present invention, the tablet unit 500 gives the video game device 12 a function of a soccer game device, and a game player directly operates a soccer player 508 to directly operate the receiving antenna 522, whereby the game can be more realistic. In addition, according to the present embodiment, the receiving antenna 522 and the touch pen 32 are displaced in accordance with movements of the soccer player 508, which enables a game player to play the game intuitive operations without using complicated directional button 24 and execution button 26, which can improve response in the game.

A Fifth Embodiment: Shooting Tablet

Then a shooting tablet unit which is the tablet unit according to a fifth embodiment of the present invention will be explained with reference to FIGS. 13 and 14.

Figure 13:
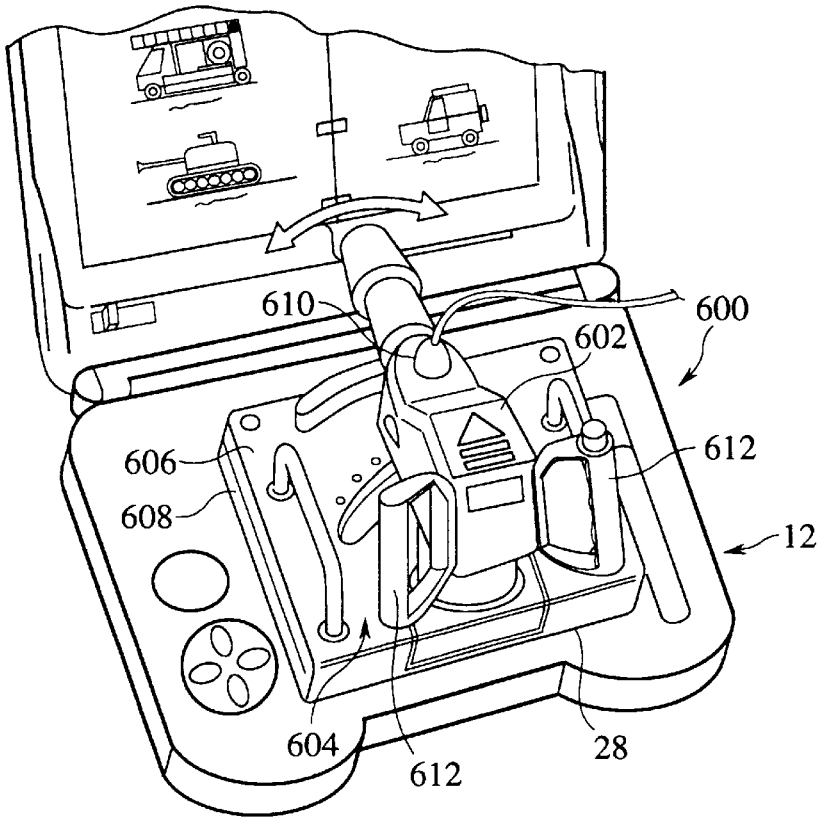
FIG. 13 is a perspective view of an appearance of a shooting game tablet unit according to a fifth embodiment of the present invention.
Figure 14:
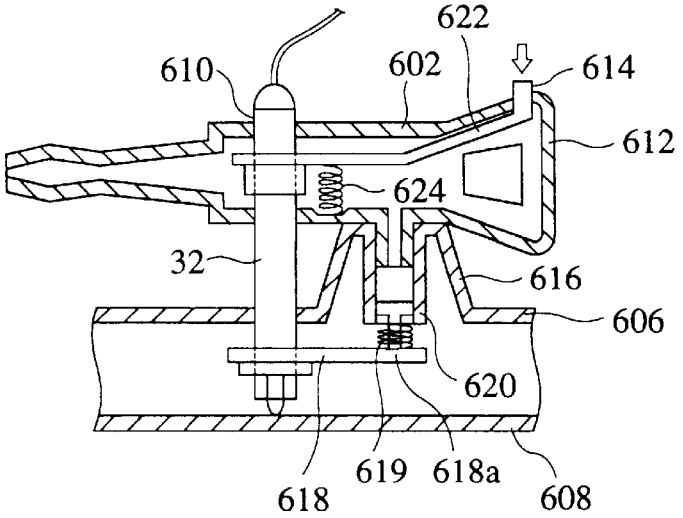
FIG. 14 is a view of an appearance of a touch pen drive mechanism of the tablet unit of FIG. 13.

FIG. 13 is a perspective view of the shooting tablet unit mounted on a video game device. As shown in FIG. 13, the tablet unit 600 is mounted on a tablet 28 of the video game device 12. The tablet unit 600 includes a body 60 with a gun 602 mounted on. The body is formed in the shape of a box formed by assembling an upper lid 606 and a back lid 608. The gun 602 is mounted on the upper lid swingably left and right. Near the forward end of the gun 602, a touch pen mount 610 for receiving a touch pen from above is disposed. The back lid 608 covers the tablet 28. As shown in FIG. 14, the gun 602 includes grips 612 disposed on the side opposed to a game player. A trigger button 614 called a trigger is withdrawably provided in one of the grips 612. A gun seat 616 for the gun 602 mounted on is projected upward with respect to the upper lid 606. In the interior of the body, a boss 620 for mounting a lower support arm 618 which supports the forward end portion of the inserted touch pen 32 vertically movably with respect to the gun seat. The lower support arm 618 includes a shaft 618*a* inserted in the boss 620 through a spring 619 and is mounted on the boss by suitable means vertically movably and preventively of fall by suitable means.

The touch pen 32 has the portion on the side of the cord integrally supported by an upper support arm 622 which is integral with the trigger button 614, and the upper support arm 622 is urged upward by a spring 624 seated in the gun body. The touch pen 32 is always in contact with the inside surface of the back lid 608.

The operation of the tablet unit 600 having the above-described structure will be explained.

First, the tablet unit 600 is mounted on the tablet 28 of the video game device 12, and the touch pen 32 is inserted in the touch pen mount 610 is secured to the upper support arm 622.

In this state, a game player rotates the gun 602 on the gun seat 616 by using the grips 612 with respect to an object displayed on an image monitor (in the directions of double arrow in the drawing). Because the touch pen 32 is always in contact with the back lid 608, the object can be followed based on positional information of the touch pen 32. When the player aims at the object and presses down the trigger button 614, downward force of the trigger button 614 is transmitted to the touch pen 32 through the upper support arm 622, then the touch pen is lowered with respect to the gun 602, and the switch on the pen tip is pressed. Then a bullet is fired to shoot down an enemy plane.

In the game, a game player moves the gun 602 left and right, and presses the trigger button 614, whereby enemy planes displayed on the image monitor are shot down, or attack vehicles, such as war vehicles, armored cars, etc., and the game player competes in points counted by, e.g., numbers of shoot-downs.

As described above, according to the fifth embodiment of the present invention, the tablet unit 600 gives the video game device 12 a function of a shooting game device, and a player directly operates a toy gun to aim at an object and shoot it. This makes the game more realistic. In addition, according to the present embodiment, the touch pen 32 is displaced in accordance with motions of the gun 602, which makes it possible to omit the receiving antenna to the advantage of lower costs.

A Sixth Embodiment: Register Tablet

Next, the register tablet unit according to a sixth embodiment of the present invention will be explained with reference to FIGS. 15 to 17.

Figure 15:
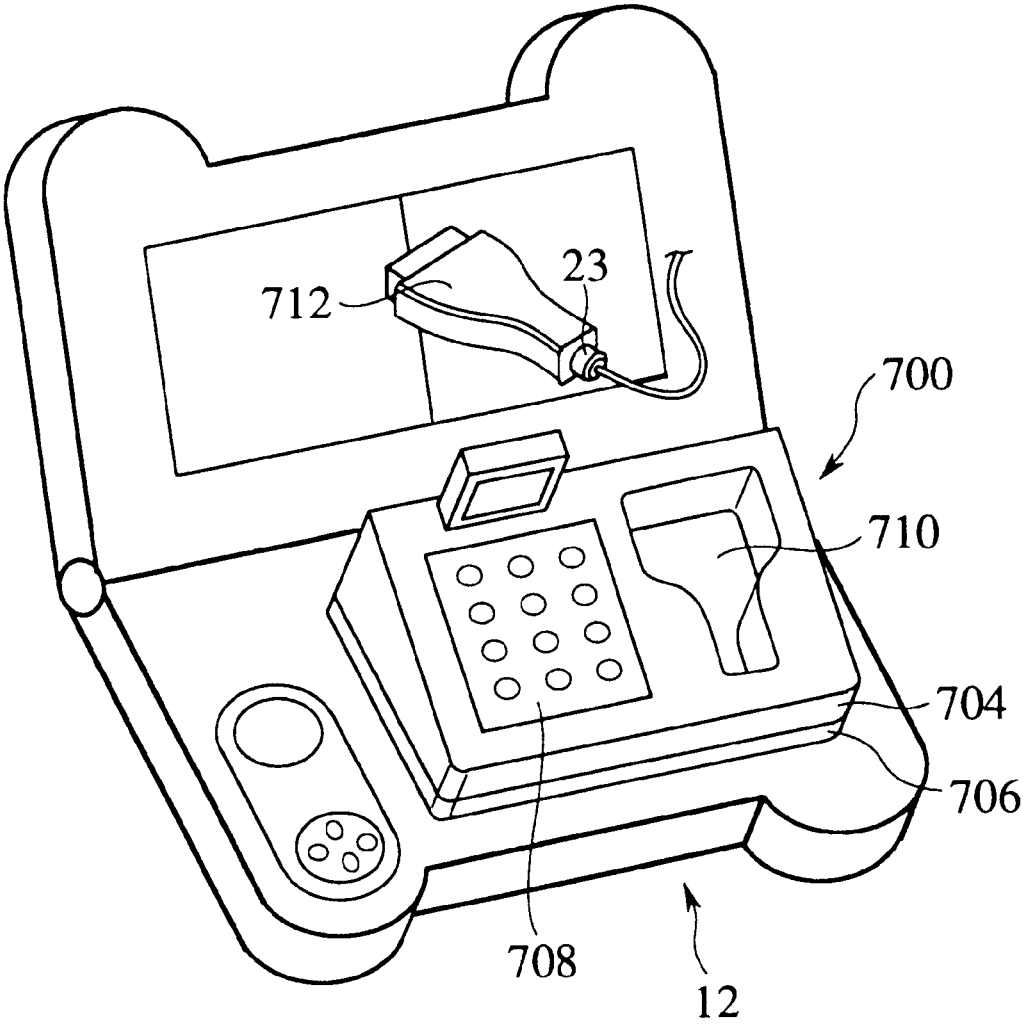
FIG. 15 is a perspective view of an appearance of a register game tablet unit according to a sixth embodiment of the present invention.

FIG. 15 is a perspective view of the register tablet unit 700 mounted on a video game device 12. As shown in FIG. 15, the register tablet unit 700 covers a tablet 28 of the video game device (FIG. 18), and includes a body 702 imitating a register.

The body is formed by assembling an upper lid 704 and a back lid 706. On the upper lid 704, register button unit 708 and a grip set unit 710 are disposed as in a register. The back lid 706 covers the tablet 28.

The register tablet unit 700 includes a bar code reader-type grip 712 on which a touch pen 32 can be mounted. FIG. 16 shows sectional views of examples of the grips which are usable on the present embodiment.

Figure 16A:
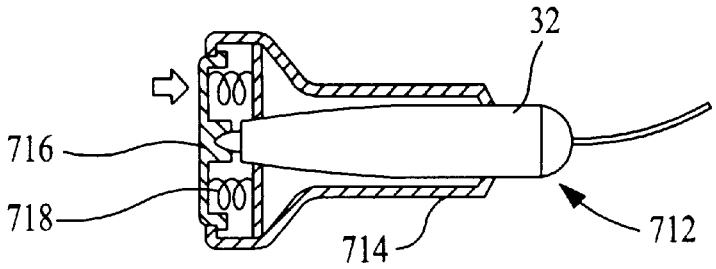
FIGS. 16A to 16C are sectional views of grips of the tablet unit of FIG. 15, which shows a structure thereof.

As shown in FIG. 16A, the grip 712 mainly includes a substantially T-shaped grip casing 714, a receiver socket 716 which is positioned on the forward end of the grip 717 and is withdrawable with respect to the grip casing 714, and a spring 718 urging the receiver socket 716 to the front of the grip. The receiver socket 716 is, e.g., a one-piece molding, and has a recess 716*a* for receiving the pen tip 32*a* of the touch pen formed in the side thereof near the grip casing 714. The grip 712 is for pressing a specific pattern on picture software 22 (FIG. 18) mounted on the video game device 12. The grip 12 is pressed into the picture software 22 and the receiver socket 716 is pushed toward the touch pen by its reaction force, and the switch of the touch pen 32 is turned on.

A distance between the transmitting surface (the side of the picture software) and the receiver side (the pen tip 32*a*) is made as short as possible so that receiving efficiency of the grip 712 pressing down the picture book software surface to receive is not lowered.

Figure 16B:
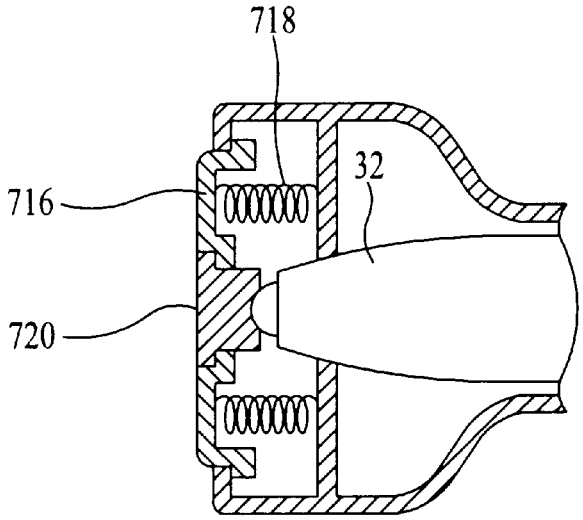
Figure 16C:
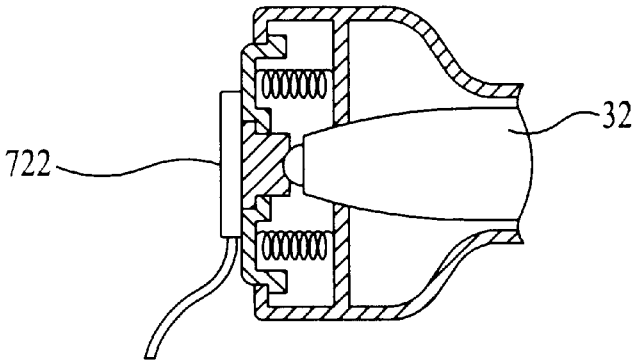

The tablet unit 700 can receive, in addition to information from the picture book software, information from the register button unit 708 operated by a game player. FIG. 16B shows a grip which can receive positional information from the tablet side in addition to the above-described receiving efficiency improvement. In addition to the structure of FIG. 16A, a metal member 720 for inputting positional information (electromagnetic waves) from the tablet 28 is buried in the center of the receiving socket 16. In this information transmission, with the grip 712 mounted on the grip set unit 710, register buttons are pressed to transmit electromagnetic waves from the register buttons to the grip set unit 710, and a transmission metal member 722 disposed here and the metal member 720 contact each other to thereby button information is transmitted to the touch pen 32 (FIG. 16C).

Figure 17A:
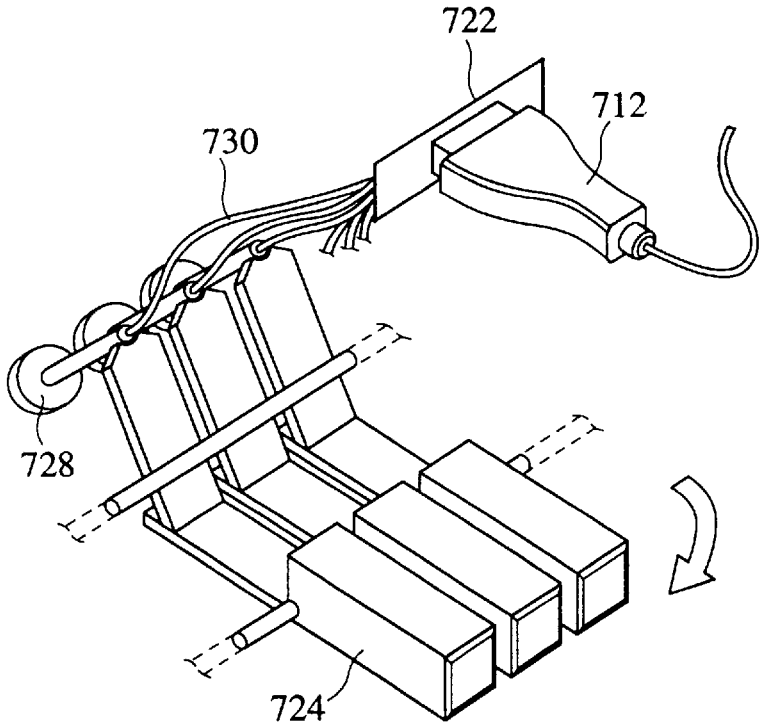
FIGS. 17A and 17B are views of an example of receiving antenna drive mechanism of the tablet unit of FIG. 15.
Figure 17B:
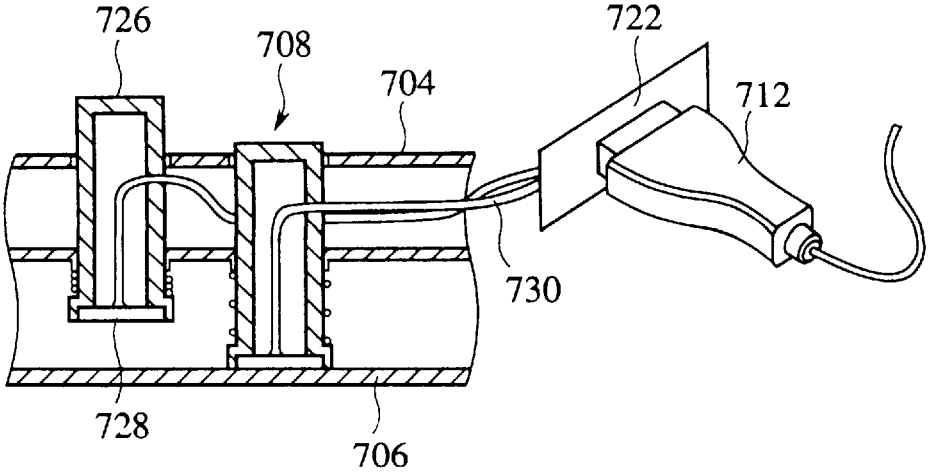

FIGS. 17A and 17B show a second embodiment showing relationships between the register button unit 708 and the transmission metal part 722 disposed on the grip set unit 701. FIG. 17A shows an example including key-shaped register buttons 724 similar to those of the second embodiment, and FIG. 17B shows an example including vertical movable usual buttons 726. Receiving antenna 728 associated with the respective buttons are provided, and the receiving antennas 728 are pressed against the back lid to receive electromagnetic waves from the tablet and transmits the electromagnetic waves to the metal member 722 through a cable 730.

As described above, according to the sixth embodiment of the present invention, the tablet unit 700 gives the video game device 12 a function of the bar code register, and a game player holds and operates the grip 712 to receive optionally from the picture book software or from the tablet surface, whereby shopping games can have more functions, which makes the games more amusing.

Modifications

The present invention is not limited to the above-described embodiments and covers various modifications. For example, the present invention is usable as tablets for portable electric computers, slip-in puzzle games, multi-musical instruments, such as drums, etc. in addition to the above-described keyboard, handles of motor bikes, etc.

What is claimed is:

1. A tablet unit to be mounted on a game device, said game device including a tablet and a touch pen for cooperating with said tablet to input command information to said game device, said tablet unit comprising:

a unit body having means for mounting on the game device to cover the tablet;

contact means supported by the unit body, said contact means contacting the tablet when said unit body is mounted on said game device, said contacting means further comprising signal transferring means for transferring signals to the touch pen; and operating means for operating the contact means so as to change a contact position of the contact means contacting the tablet, the contact means being contacted to the tablet to input command information in the game device when said unit body is mounted on said game device.

2. A tablet unit according to claim 1, wherein the unit body physically simulates a dashboard; and the operating means includes at least a handle, an ignition key and a shift lever.

3. A tablet unit according to claim 1, wherein the unit body physically simulates a keyboard musical instrument; the operating means includes at least a plurality of keys; and the contact means is provided for each of said plurality of keys.

4. A tablet unit according to claim 1, wherein the unit body physically simulates a clock;

the operating means includes at least a clock needle to be rotated by an operator; and the contact means is disposed on the clock needle.

5. A tablet unit according to claim 1, wherein the unit body physically simulates an athletic museum; and the operating means includes at least a doll athlete which can be moved by an operator in the athletic museum.

6. A tablet unit according to claim 1, wherein the unit body contains an area for holding the touch pen.

7. A tablet unit according to claim 1, wherein said contact means receives electromagnetic waves from the tablet and said signal transferring means transmits electromagnetic waves to the touch pen.

8. A tablet unit to be mounted on a game device, said game device including a tablet and a touch pen for cooperating with said tablet to input command information to said game device, said tablet unit comprising:

a unit body having means for mounting on the game device to cover the tablet;

holding means disposed in the unit body, for holding the touch pen movably with respect to the tablet when said tablet unit is mounted on said game device, the touch pen being contacted to the tablet to input command information into the game device; and operating means for operating the holding means to change a contact position of the touch pen.

9. A tablet unit according to claim 8, wherein the unit body physically simulates a gun; and the operating means includes at least a trigger button of the gun.

10. A tablet unit according to claim 8, wherein the unit body physically simulates a bar code register; and the operating means includes an actuator for the touch pen.

11. A tablet unit according to claim 8, wherein said holding means causes the touch pen to receive electromagnetic waves from the tablet when said operating means operates the holding means.

12. A tablet unit to be mounted on an electronic device, the electronic device including a tablet and a touch pen for cooperating with said tablet to input command information to the electronic device, said tablet unit comprising:

a unit body having means for mounting on the electronic device to cover the tablet;

contact means supported by the unit body, said contact means contacting the tablet when said unit body is mounted on the electronic device, said contact means further comprising signal transferring means for transferring signals to the touch pen; and operating means for operating the contact means so as to change a contact position of the contact means contacting the tablet, the contact means being contacted to the tablet to input command information in the electronic device when said unit body is mounted on the electronic device.

13. A tablet unit to be mounted on an electronic device, the electronic device including a tablet and a touch pen for cooperating with said tablet to input command information to the electronic device, said tablet unit comprising:

a unit body having means for mounting on the electronic device to cover the tablet;

holding means disposed in the unit body, for holding the touch pen movably with respect to the tablet when said tablet unit is mounted on the electronic device, the touch pen being contacted to the tablet to input command information into the electronic device; and operating means for operating the holding means to change a contact position of the touch pen.

* * * * *